US009913772B2

(12) United States Patent
Johnson et al.

(10) Patent No.: US 9,913,772 B2
(45) **Date of Patent: *Mar. 13, 2018**

(54) MULTIFUNCTIONAL AIRCRAFT AISLE WHEELCHAIR AND RELATED SYSTEMS AND METHODS

(71) Applicant: Dane Technologies, Inc., Brooklyn Park, MN (US)

(72) Inventors: Dan Johnson, Medina, MN (US); Andrew Dvorak, Minnetonka, MN (US)

(73) Assignee: Dane Technologies, Inc., Brooklyn Park, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/434,274

(22) Filed: Feb. 16, 2017

(65) Prior Publication Data

US 2017/0156960 A1 Jun. 8, 2017

Related U.S. Application Data

(63) Continuation of application No. 14/281,217, filed on May 19, 2014, now Pat. No. 9,775,753.

(60) Provisional application No. 61/824,410, filed on May 17, 2013, provisional application No. 61/866,088, filed on Aug. 15, 2013.

(51) Int. Cl.

| | |
|---|---|
| ***A61G 7/10*** | (2006.01) |
| ***A61G 3/06*** | (2006.01) |
| ***A61G 5/10*** | (2006.01) |

(52) U.S. Cl.

CPC ..... *A61G 7/1034* (2013.01); *A61G 3/063* (2013.01); *A61G 5/1056* (2013.01); *A61G 7/1015* (2013.01); *A61G 7/1032* (2013.01); *A61G 7/1036* (2013.01); *A61G 7/1046* (2013.01); *A61G 7/1059* (2013.01); *A61G 2220/10* (2013.01)

(58) Field of Classification Search

CPC .... A61G 3/063; A61G 5/1056; A61G 7/1015; A61G 7/1032; A61G 7/1034; A61G 7/1036; A61G 7/1046; A61G 7/1059; A61G 2220/10

USPC ..... 297/311; 414/528, 542, 812, 921

See application file for complete search history.

(56) References Cited

U.S. PATENT DOCUMENTS

| | | | | |
|---|---|---|---|---|
| 2,439,163 A * | 4/1948 | Farmer | ..... | A61G 7/053 5/86.1 |
| 2,854,673 A * | 10/1958 | De Witt | ..... | A61G 7/053 254/124 |
| 4,837,873 A * | 6/1989 | DiMatteo | ..... | A61G 5/006 5/81.1 C |
| 5,152,016 A * | 10/1992 | Becker | ..... | A61G 7/103 193/35 R |
| 5,669,620 A | 9/1997 | Robbins | | |
| 5,802,632 A * | 9/1998 | Campbell | ..... | A61G 7/103 198/321 |

(Continued)

*Primary Examiner* — Charles A Fox
*Assistant Examiner* — Joseph J. Sadlon
(74) *Attorney, Agent, or Firm* — Davis, Brown, Koehn, Shors & Roberts, P.C.

(57) ABSTRACT

The various embodiments disclosed herein relate to wheelchair systems for transporting a mobility-challenged passenger onto an aircraft and transfer that passenger into an aircraft seat. The implementations include systems with lift systems, belt systems, and/or transfer ramps.

20 Claims, 34 Drawing Sheets

(56) References Cited

U.S. PATENT DOCUMENTS

| | | | | |
|---|---|---|---|---|
| 6,154,690 | A * | 11/2000 | Coleman | A61G 5/006 180/65.1 |
| 8,250,687 | B2 * | 8/2012 | Spidare | A61G 7/1017 5/81.1 R |
| 9,668,929 | B2 * | 6/2017 | Patterson | A61G 7/1032 |
| 9,693,915 | B2 * | 7/2017 | Turner | A61G 7/1034 |
| 2010/0251481 | A1 | 10/2010 | Hay | |

* cited by examiner

MULTIFUNCTIONAL AIRCRAFT AISLE WHEELCHAIR AND RELATED SYSTEMS AND METHODS

CROSS-REFERENCE TO RELATED APPLICATION(S)

This application claims priority as a continuation to U.S. application Ser. No. 14/281,217, filed on May 19, 2014 and entitled "Methods, Systems, and Devices Relating to Multifunctional Aircraft Aisle Wheelchair, which claims priority to U.S. Provisional Application 61/824,410, filed on May 17, 2013 and entitled "Methods, Systems, and Devices Relating to Multifunctional Aircraft Aisle Wheelchair" and U.S. Provisional Application 61/866,088, filed on Aug. 15, 2013 and entitled "Methods, Systems, and Devices Relating to Multifunctional Aircraft Aisle Wheelchair," all of which are hereby incorporated herein by reference in their entireties.

FIELD OF THE INVENTION

The various embodiments disclosed herein relate to wheelchair systems, and more specifically to wheelchair systems configured to transport a mobility-challenged passenger onto an aircraft and transfer that passenger into an aircraft seat.

BACKGROUND OF THE INVENTION

It is currently estimated that approximately 3 million U.S. citizens have diminished mobility that requires the use of mobility aids such as walkers or wheelchairs in their daily life. Many have lost mobility due to age, while many are mobility-challenged due to accident, injury, or illness. Statistics show that the number of people requiring mobility aids will continue to increase due both to an aging population and to a growing number of those impaired as a result of accident, injury, or illness.

On the other hand, commercial air travel has experienced consistent growth over the past 20 years, and mobility-challenged individuals have and will continue to be a part of that trend. The net result is that there is a large and growing population base of air travelers that are mobility-challenged. This has created a new set of challenges for airlines as they seek to enable air travel for those customers.

At the same time, there have been few advancements in the technology used to move a passenger through an airport, down a jet way, and into a seat on a plane. The vast majority of technology in use today has been available for many years. Manual wheelchairs (also called "transport wheelchairs") are used to move passengers from arrival through the terminal to their departure gate. One common transport wheelchair used by many airports for transport through the airport is called a "Staxi" chair. Regardless, transport wheelchairs require a transfer at the departure gate to a traditional, known "aisle chair," which is a wheeled chair that has been designed to be narrow enough to fit in the aisle of an airplane. The typical aisle width is 17 to 20 inches, but in some cases can be as narrow as 16 inches. These standard aisle chairs have four fixed wheels that require the user to tip the chair to turn it in the narrow entrance to the plane.

These existing aisle chairs require that the airline team use substantial physical effort to first lift the passenger and then move them laterally into their seat on the plane. This is typically accomplished with one airline team member reaching over the back of the aisle chair to "bear hug" the passenger while another airline team member lifts at the passenger's knees to try and help move them laterally. Given the narrow aisle, the narrow space between plane seats, and the height of the plane seat back, the process of a physical lift and a lateral move poses significant risk of injury to the passenger and the airline team member. In addition, the passenger experience is less than dignified. These challenges are exacerbated by the rapidly increasing average weight of the population and, as a result, airline passengers.

At the same time that the logistics of mobility challenged passenger movement and transfers are becoming more frequent, more challenging, and more time consuming, the average age of the workforce is rising, thereby increasing the risk of injury to airline team members. As we age, it is very well documented that our ability to safely lift or move loads decreases in weight and frequency. That means that the average airline worker cannot safely increase the weight or frequency of what they are being asked to move. This is compounded by the fact that there is now an increasing number of mobility challenged passengers that weigh more.

The result is a situation that has significant potential to negatively impact passenger safety, airline employee safety, turn time efficiency and passenger dignity.

There is a need in the art for improved motorized wheelchair systems for transport and transfer of aircraft passengers.

BRIEF SUMMARY OF THE INVENTION

Discussed herein are various wheelchair transfer system embodiments, including wheelchair transfer systems with lift systems, belt systems, or transfer ramps. All of the various implementations are configured to assist with transport of a mobility-challenged passenger onto an aircraft and transfer of that passenger into an aircraft seat.

In Example 1, a wheelchair transfer system comprises a wheelchair frame, a lift system, and four wheels operably coupled to the transfer system. The wheelchair frame comprises a wheelchair seat and a wheelchair back. The lift system is moveably coupled to the wheelchair back and comprises first and second vertical rods, a coupling component operably coupled to the wheelchair back, first and second horizontal support arms operably coupled to the first and second vertical rods, respectively, at least two pulleys operably coupled to the first and second support arms, a lift seat positionable on the wheelchair seat, and a set of cables operably coupled to the at least two pulleys and the lift seat. The first and second vertical rods are slidably coupled to the coupling component, whereby the vertical rods can be moved laterally between an undeployed position and a deployed position. The lift seat can be moved between a raised position and a lowered position by the set of cables.

Example 2 relates to the wheelchair transfer system according to Example 1, further comprising a stabilization system comprising four legs operably coupled to the wheelchair frame, wherein the four legs are configured to be moveable between an undeployed position and a deployed position.

Example 3 relates to the wheelchair transfer system according to Example 1, further comprising a stabilization bar operably coupled to a bottom portion of the first and second vertical rods, the stabilization bar comprising at least two wheels.

Example 4 relates to the wheelchair transfer system according to Example 1, wherein the four wheels are operably coupled to the wheelchair frame. Example 5 relates to the wheelchair transfer system according to Example 1, wherein the four wheels comprising first and second front wheels and first and second rear wheels, wherein the first and second front wheels are operably coupled to the wheelchair frame, and further wherein the first and second rear wheels are operably coupled to the lift system.

Example 6 relates to the wheelchair transfer system according to Example 1, further comprising a transfer ramp removably positionable within an opening defined in the wheelchair seat, wherein the transfer ramp is configured to move between an undeployed position and a deployed position.

Example 7 relates to the wheelchair transfer system according to Example 1, wherein the at least two pulleys comprise four pulleys.

Example 8 relates to the wheelchair transfer system according to Example 1, wherein the first and second horizontal support arms are integral with the first and second vertical rods.

In Example 9, a wheelchair transfer system comprises a wheelchair seat comprising a transfer belt system, first and second front legs operably coupled to the wheelchair seat, first and second front wheels operably coupled to the first and second front legs, a seat back operably coupled to the wheelchair seat, a rear frame support operably coupled to the seat back via a connector, first and second rear legs operably coupled to the rear seat back, and first and second rear wheels operably coupled to the first and second rear legs. A space is defined between the front and rear seat backs, wherein the space is sufficiently large to allow an aircraft seatback to be positioned between the front and rear seat backs.

Example 10 relates to the wheelchair transfer system according to Example 9, wherein the first and second front wheels and the first and second rear wheels are swivel wheels.

Example 11 relates to the wheelchair transfer system according to Example 9, wherein the first and second front wheels are swivel wheels and the first and second rear wheels are fixed wheels.

Example 12 relates to the wheelchair transfer system according to Example 11, further comprising a secondary wheel system comprising at least two secondary wheels positioned between the first and second rear wheels, wherein the secondary wheel system is configured to move between an undeployed configuration and a deployed configuration in which the two secondary wheels are in contact with a floor whereby the transfer system can be moved sideways via the two secondary wheels.

Example 13 relates to the wheelchair transfer system according to Example 9, wherein the transfer belt system comprises a support frame, a transfer belt positioned around the support frame, at least one drive roller operably coupled to the support frame, and at least one support roller operably coupled to the support frame. The at least one drive roller is operably coupled to the support frame whereby rotation of the at least one drive roller causes the transfer belt to move around the support frame. The at least one support roller is configured to provide support to the transfer belt.

In Example 14, a method of transferring a mobility-challenged individual from a wheelchair to an aircraft seat comprises positioning a wheelchair on an aircraft in an aircraft aisle next to a target aircraft seat row, actuating a transfer system on the wheelchair to transfer the individual to a target aircraft seat in the target aircraft seat row, and removing the wheelchair from the aircraft. The transfer system comprises at least one of a lift system, a transfer ramp, and a transfer belt system.

Example 15 relates to the method according to Example 14, wherein the transfer system is the lift system, wherein the actuating the lift system further comprises raising a lift seat positioned on a wheelchair seat via a set of cables coupled to first and second horizontal support arms, thereby raising the individual from the wheelchair seat, moving the lift system laterally from an undeployed position toward the target aircraft seat until the lift seat is positioned above the target aircraft seat, and lowering the lift seat via the set of cables until the lift seat is positioned on the target aircraft seat.

Example 16 relates to the method according to Example 15, further comprising removing the set of cables from the lift seat after the lift seat is positioned on the target aircraft seat, retracting the lift system laterally to the undeployed position, and removing the wheelchair from the aircraft.

Example 17 relates to the method according to Example 14, wherein the transfer system is the transfer belt system, the method further comprising adjusting the height of the wheelchair to ensure that the wheelchair can be positioned over aircraft seats in the target aircraft seat row, moving the wheelchair laterally toward the target aircraft seat over the aircraft seats in the target aircraft seat row until the wheelchair is positioned substantially above at least a portion of the target aircraft seat, and lowering the wheelchair until the wheelchair is in contact with the target aircraft seat. The actuating the transfer belt system further comprises actuating a transfer belt to move around a support frame, whereby the individual is moved laterally off of the transfer belt and onto the target aircraft seat.

Example 18 relates to the method according to Example 17, further comprising raising the wheelchair after the individual has been moved onto the target aircraft seat, moving the wheelchair laterally toward the aircraft aisle until the wheelchair is positioned in the aircraft aisle, and removing the wheelchair from the aircraft.

Example 19 relates to the method according to Example 14, wherein the transfer system is the transfer ramp, the method further comprising adjusting the height of the wheelchair to ensure that a wheelchair seat has a height that is greater than a height of the target aircraft seat. The actuating the transfer ramp further comprises deploying the transfer ramp from an opening defined in the wheelchair seat such that a distal portion of the transfer ramp is positioned on the target aircraft seat, whereby the individual can be moved from the wheelchair seat to the target aircraft seat via the transfer ramp.

Example 20 relates to the method according to Example 19, further comprising retracting the transfer ramp to an undeployed position within the opening in the wheelchair seat after the individual has been moved onto the target aircraft seat, and removing the wheelchair from the aircraft.

Certain embodiments of motorized wheelchair systems disclosed herein have an integrated lift and transfer system that allows the passenger to be lifted via a lift seat. The system allows the passenger to be moved laterally in either direction, thereby allowing the passenger to be lifted and moved laterally from the system into their aircraft seat with little or no physical effort being required by the airline team member or the passenger.

The integrated lift and transfer system is, in some embodiments, a bi-directional sliding lateral transfer lift system incorporated into the wheelchair system. Once the passenger is lifted, the lifting system can be extended in either direction to allow the passenger to be moved laterally while at the same time maintaining stability. The sliding lateral transfer lift system maintains a strong connection to the wheelchair system and can me moved laterally via a powered system, such as a linear actuator, or with a manual system.

Once the lift system has moved the passenger laterally such that the passenger is located above her seat, the lift and transfer system can be lowered to place the passenger in her seat. The lifting system can be a manual system (via a hydraulic or other manual lifting system) or a powered system (via a motor and gear or via a linear actuator).

In certain embodiments, the lift seat is a user-friendly and comfortable flexible cushioned seat that remains under the passenger while she is in her seat on the aircraft, thereby providing additional support and comfort to the passenger during the flight. Further, retaining the lift seat with the passenger during the flight enables easy transfer and transport at both the departure and arrival airport. Alternatively, it could remain in each respective location.

Other embodiments relate to systems having a lateral transfer surface or ramp incorporated into the seat such that the ramp can be extended to bridge the gap between the wheelchair system and another seat, such as an aircraft seat. In certain implementations, the surface or ramp is a low-friction surface or incorporates a continuous transport belt (either manual or powered) that allows the user to easily move along the ramp. In these lateral transfer ramp embodiments, the wheelchair system is configured to have a seat that can be raised or lowered such that the process of moving the passenger from the system to their aircraft seat (or another seat) can be accomplished by raising the seat of the system to a height that is higher than the aircraft seat and extending the ramp to the aircraft seat such that the process becomes a gravity-enabled sliding process. Similarly, the process of moving the passenger from the aircraft seat (or another seat) back to the system seat is accomplished by lowering the height of the system seat surface below the aircraft seat and extending the ramp to the seat surface.

In a further embodiment, the wheelchair system can incorporate a extendable seat and back system that is moveably coupled to the system via wheels or rollers such that the seat and back system can be moved or extended laterally in relation to the wheelchair system. In use, the wheelchair system can be positioned next to an aircraft seat (or other seat), the system can be raised or lowered as necessary to ensure the seat and back system are positioned somewhat higher than the aircraft seat, and then the seat and back system can then be extended laterally in either direction to position the passenger over the aircraft seat. In these embodiments, the seat surface of the seat and back system is a low-friction surface that allows the passenger to easily slide onto or off of the surface.

Various embodiments of the wheelchair systems contemplated herein have seats that can be raised or lowered via a powered system. Further, the systems can also be powered wheelchairs that may include powered wheels with automatic dynamic braking and brake systems.

In the various transfer systems described herein, stability can be maintained by providing one or more stability bars that can be extended from the wheelchair system (some with rollers or castors) to center the center of gravity of the combined mass of the system and passenger during transfer.

In summary, the various wheelchair system embodiments disclosed and contemplated herein allow them to serve as a multi-purpose aisle chair, enabling either a gravity-based lateral transfer or a lift and lateral transfer. These processes can be accomplished through manual or powered systems. They dramatically improve the safety of transferring a passenger while helping to preserve the dignity of the passenger. Further, if the lift seat remains with the passenger during the flight, the system can also improve the comfort and reduce the risk of injury for passengers that are paraplegics during the flight and make transfer easier upon arrival at the destination airport.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

The various embodiments disclosed herein relate to motorized wheelchair systems with multiple functionalities for use in aircraft. More specifically, these various implementations provide for easier transport and transfer of mobility-challenged passengers into and out of aircraft seats.

Figure 1:
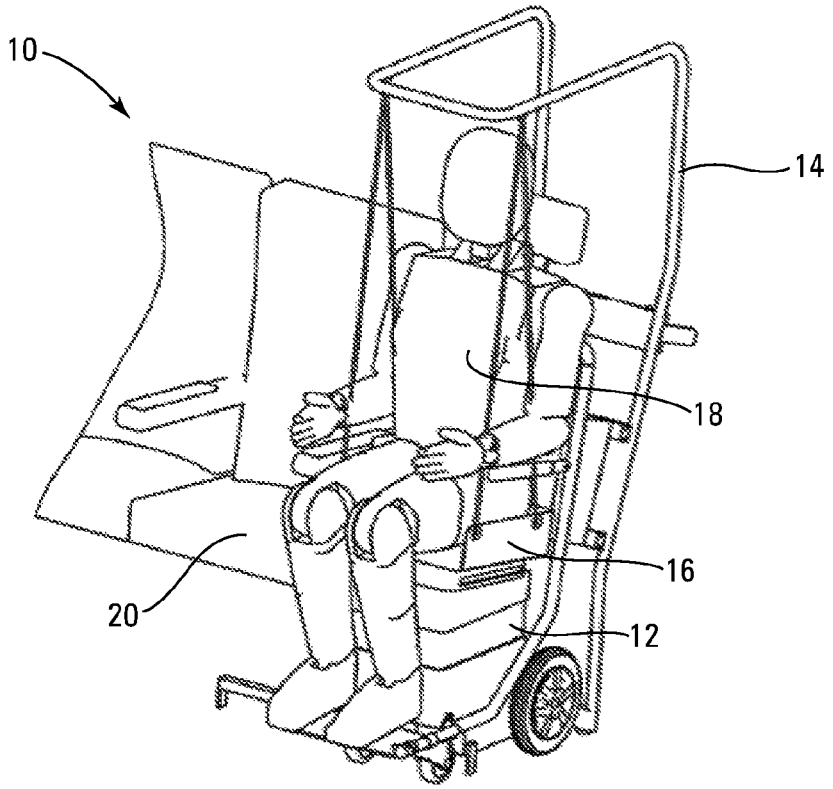
FIG. 1 is a perspective view of a wheelchair system having a lift and transfer system, according to one embodiment.
Figure 2:
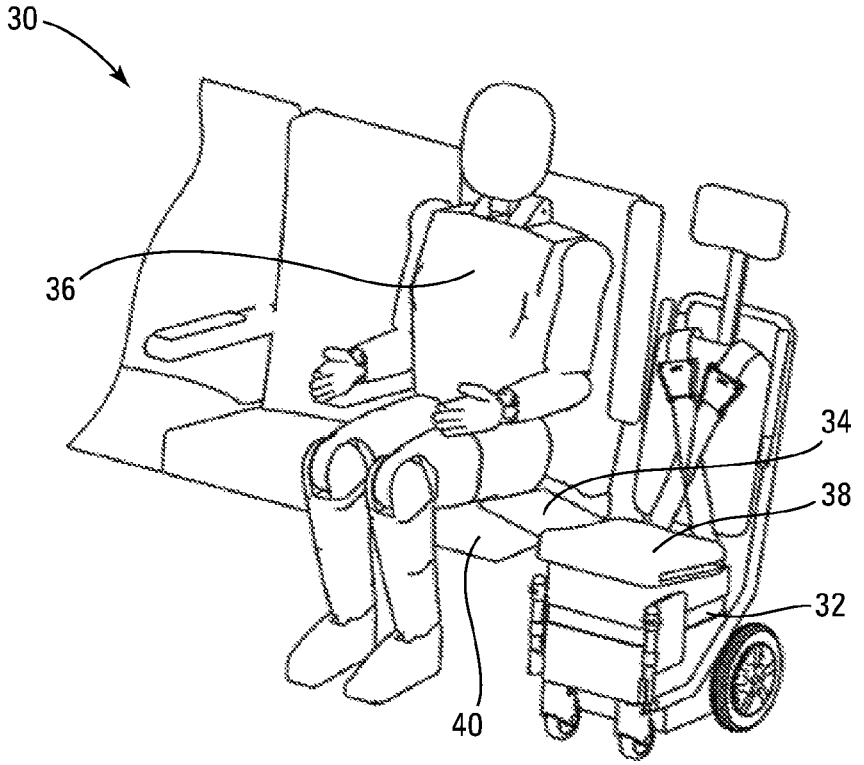
FIG. 2 is a perspective view of a wheelchair system having a transfer ramp, according to one embodiment.

FIGS. 1 and 2 depict two different exemplary motorized wheelchair system embodiments, one having a lift and transfer system 14, and the other having a transfer ramp 34. FIG. 1 depicts a motorized wheelchair system 10 according to one embodiment having an aircraft chair 12 and a lift and transfer system 14 (also referred to herein as a "lift," "lift system," "crane," or "cable lift"). The lift system 14 has a lift seat 16 in which the user 18 is seated. In use, as will be described in further detail below, the lift system 14 can be used to transfer the user between the chair 12 and another seat, such as a seat 20 on an aircraft as shown in FIG. 1. FIG. 2 depicts a second example of a motorized wheelchair system embodiment 30 having a chair 32 and a transfer tray 34 (also referred to herein as a "plate," "transfer plate," "ramp," "transfer ramp," "tongue," or "transfer tongue"). The transfer ramp 34 is positioned in a retracted position within the chair seat 38 (or elsewhere on the chair 12) and can be extended out of the chair seat 38 and positioned against or on another seat, such as a seat 40 on an aircraft, so that a user 36 can be transferred between the chair 32 and the seat 40. According to one embodiment, the system 30 with a transfer ramp 34 is used by passengers with greater mobility than those required to use a system with a lift system (such as system 10).

In a further alternative, a wheelchair system can have both a lift and transfer system similar to the system 14 in FIG. 1 and a transfer ramp similar to the ramp 34 in FIG. 2. These different systems, along with other embodiments, will be described in detail below.

It is understood that any of the wheelchair system embodiments disclosed or contemplated herein can be "motorized," meaning that motive force is provided by a motor, engine, or any other known source of motive force to actuate the system to move from one point to another and/or to actuate the various components of the system to operate as described herein. Alternatively, any of these implementations can also be manual systems, requiring motive force to be provided by the user, the person assisting the user, or someone else.

Figure 3A:
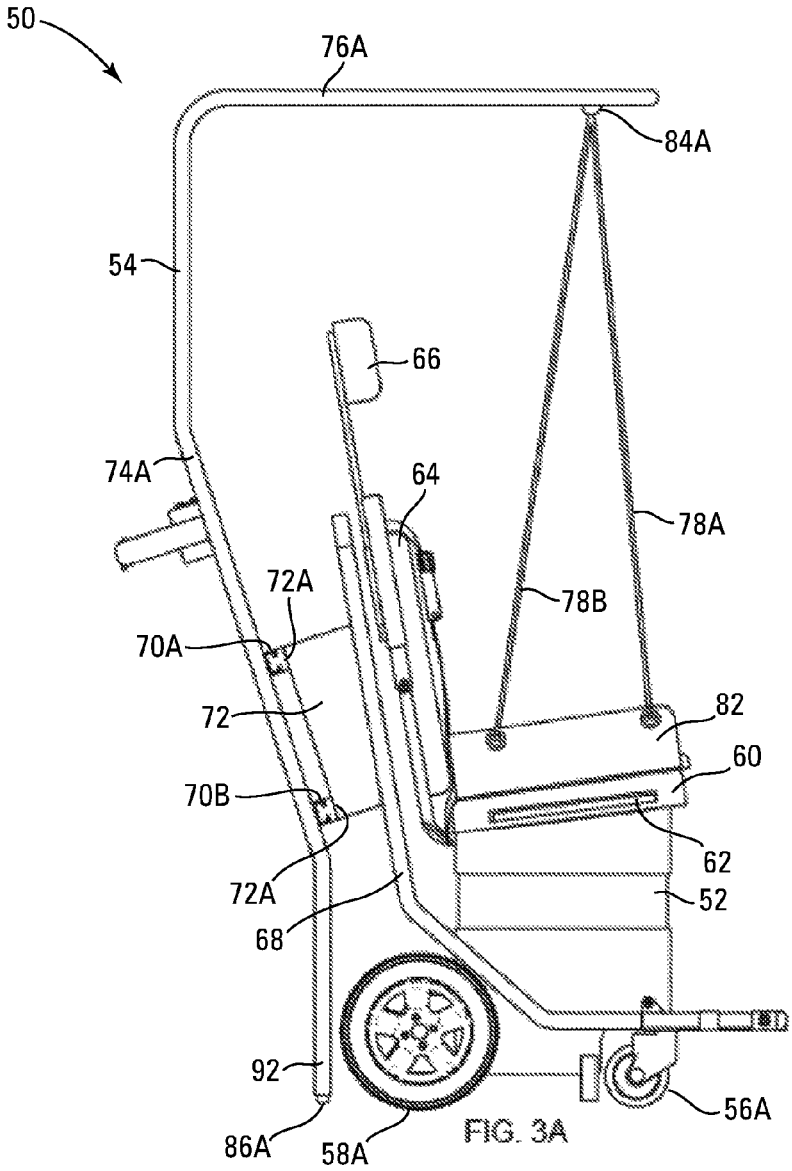
FIG. 3A is a side view of a wheelchair system having a lift and transfer system, according to another embodiment.
Figure 3B:
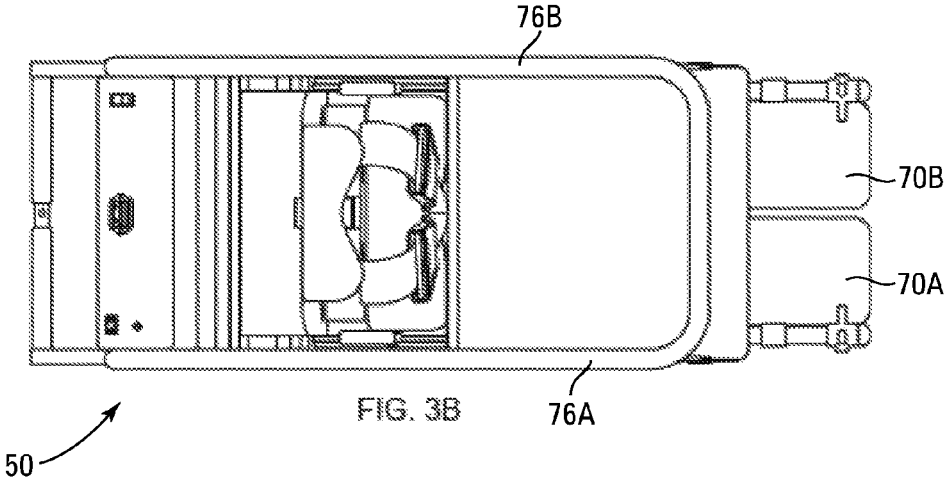
FIG. 3B is a top view of the wheelchair system of FIG. 3A, according to one embodiment.
Figure 3C:
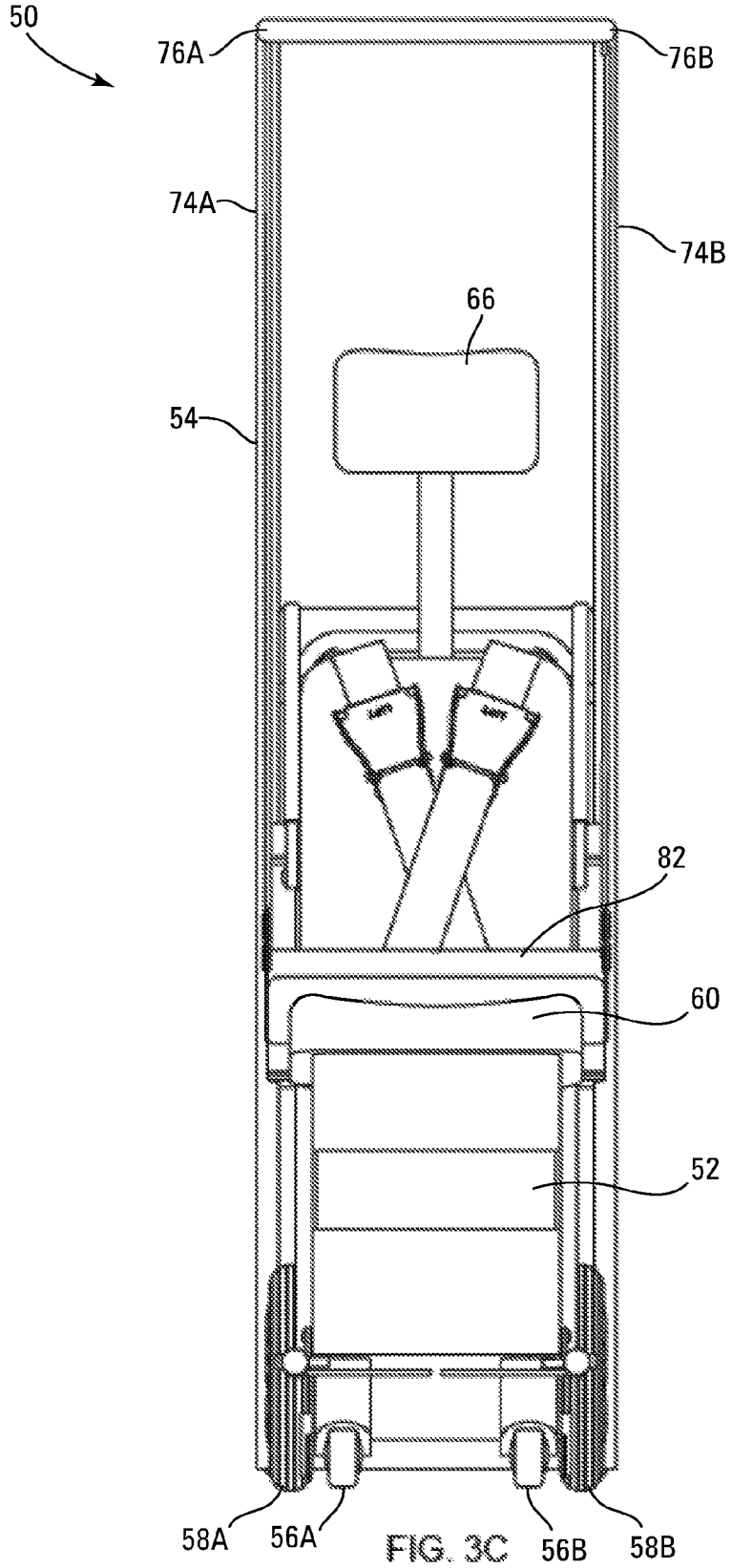
FIG. 3C is a front view of the wheelchair system of FIG. 3A, according to one embodiment.
Figure 3D:
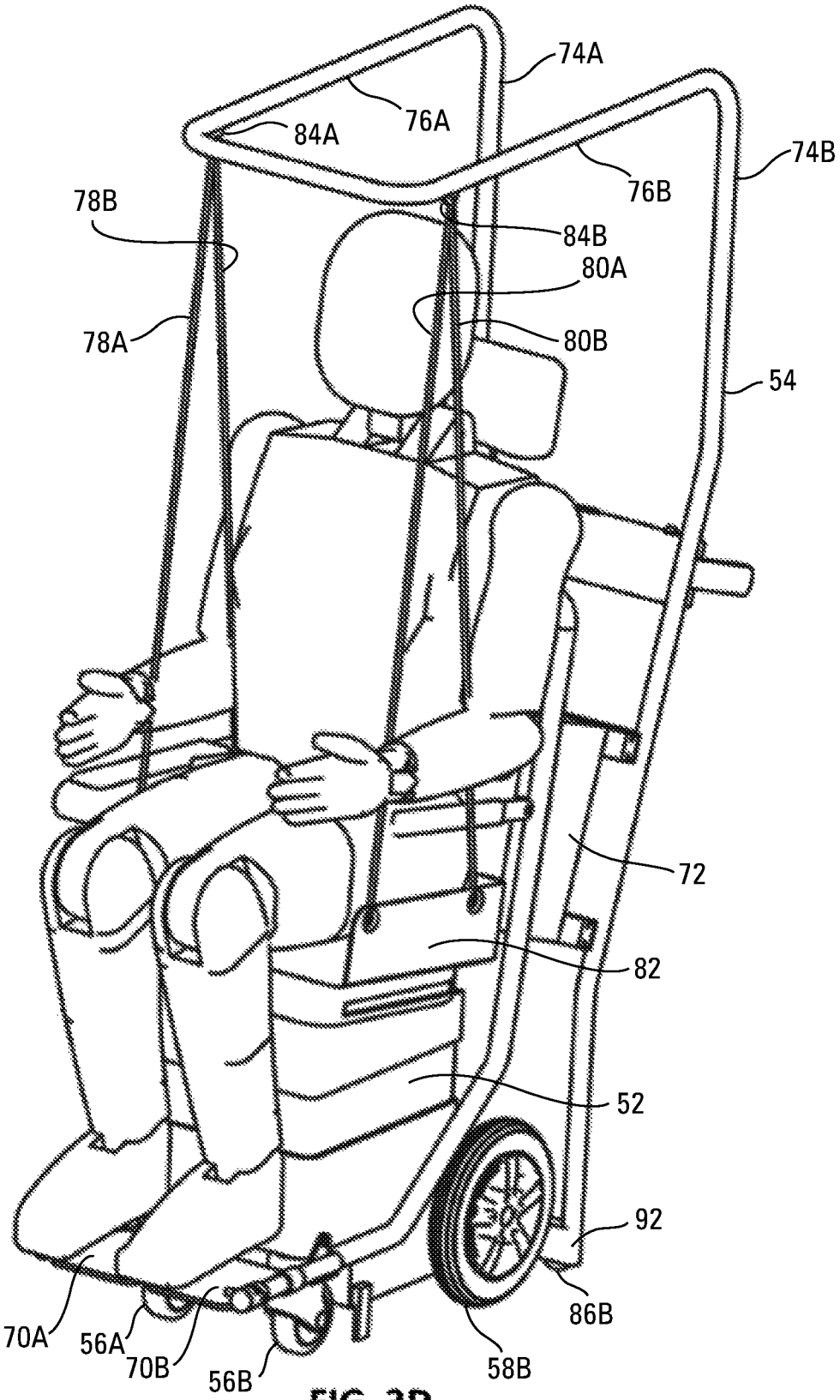
FIG. 3D is a perspective view of the wheelchair system of FIG. 3A, according to one embodiment.

Various implementations having lift systems are contemplated. One embodiment of a motorized wheelchair system 50 with a lift system 54 is depicted in FIGS. 3A, 3B, 3C, and 3D. FIG. 3A is a side view of the system 50, while FIG. 3B is a top view of the system 50, FIG. 3C is a front view of the system 50, and FIG. 3D is a perspective view of the system 50. The system 50 has a chair frame 52 and a lift system 54. The chair frame 52 has four wheels 56A, 56B, 58A, 58B (as best shown in FIGS. 3A, 3C, and 3D), including two swivel front wheels 56A, 56B and two larger fixed rear wheels 58A, 58B, and a chair seat 60 that contains a retractable transfer ramp 62 (as best shown in FIG. 3A) similar to the ramp discussed above. The chair frame 52 in this embodiment also has a backrest 64 with an extendable headrest 66. Further, the chair frame 52 has a support frame 68 (best shown in FIG. 3A) having swivel foot rests 70A, 70B (as best shown in FIG. 3B) positioned on a front portion of the frame 68 and a lift system mount 72 fixedly coupled to a back portion of the frame 68 (as best shown in FIG. 3A).

As best shown in FIGS. 3A and 3D, the lift system 54 has two substantially vertical rods 74A, 74B, a stabilization component 92 on a bottom portion of the lift 54, and two substantially horizontal support arms 76A, 76B on an upper portion of the lift 54 that extend over the chair frame 52. The system 54 also has a lift seat 82 that can be coupled to the two support arms 76A, 76B via four cables 78A, 78B, 80A, 80B extending between the arms 76A, 76B and the seat 82, as best shown in FIG. 3D. In this embodiment, the cables 78A, 78B, 80A, 80B are coupled to the arms 76A, 76B via a pulley system (made up of pulleys 84A, 84B as best shown in FIG. 3D) that allows for the cables 78A, 78B, 80A, 80B to be pulled toward the arms 76A, 76B (thereby pulling the seat 82 up) or extended away from the arms 76A, 76B (thereby allowing the seat 82 to move downward). Alternatively, the cables 78A, 78B, 80A, 80B can be operably coupled to the arms 76A, 76B via any known mechanism that allows the cables 78A, 78B, 80A, 80B to be retracted or extended. In this embodiment, each of the four cables 78A, 78B, 80A, 80B are coupled to a different corner of the seat 82. Alternatively, there can be fewer than four cables or more than four cables. In a further alternative, the arms 76A, 76B can be coupled to the seat 82 via any known component or mechanism that can be used to raise or lower the seat 82.

As best shown in FIG. 3D, the lift system stabilization component 92 is a horizontal stabilization bar 92 connecting the bottom portions of the two rods 74A, 74B. In one embodiment, the stabilization bar 92 has two swivel wheels 86A, 86B (as best shown in FIGS. 3A and 3D)—one at each end of the bar 92—that are intended to contact the surface on which the system 50 is positioned (such as the floor of the airplane cabin, for example).

Figure 4A:
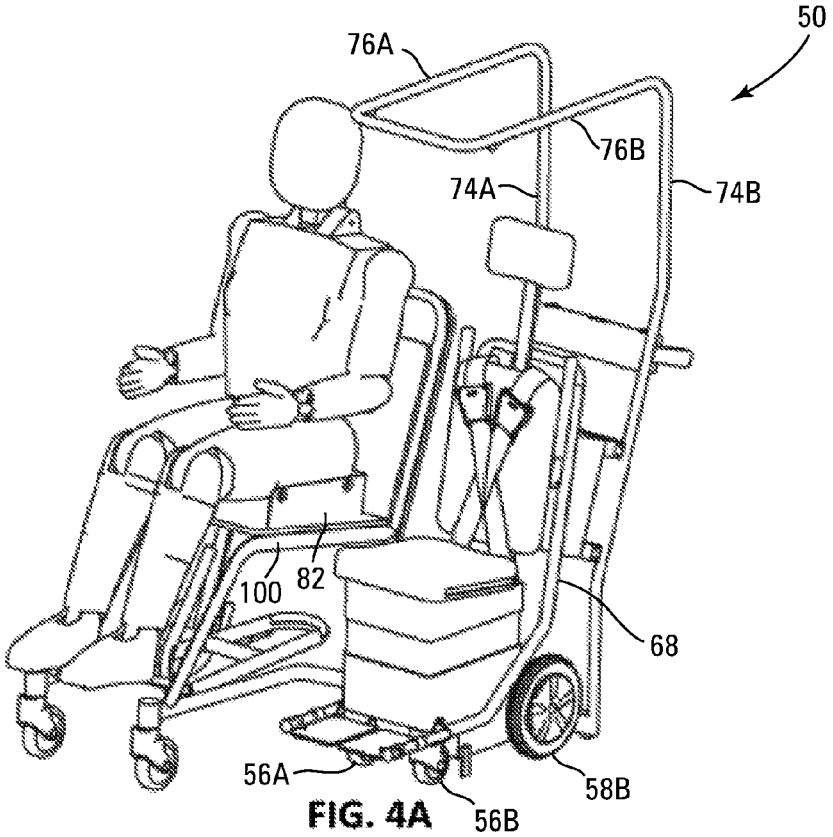
FIG. 4A is a perspective view of the wheelchair system of FIG. 3A being positioned next to a transport chair, according to one embodiment.
Figure 4B:
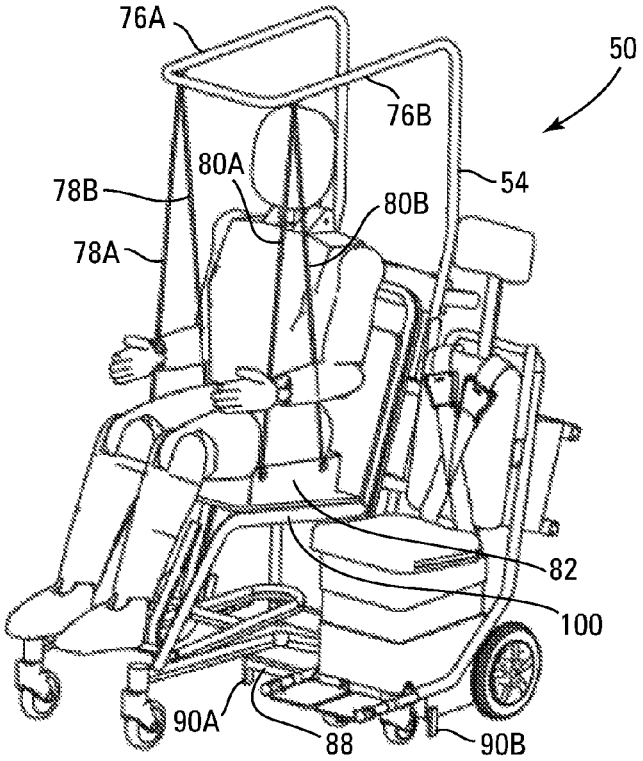
FIG. 4B is a perspective view of the wheelchair system of FIG. 3A being used to transfer a user from a transport chair to the wheelchair system, according to one embodiment.

The system 50 also has a chair stabilization component 88 (also referred to as "chair stabilization bar") as best shown in FIG. 4B. The chair stabilization bar 88 has two feet 90A, 90B, with one at each end of the bar 88. The stabilization bar 88 can be positioned on the surface on which the system 50 is positioned during use of the system 50, as will be described in further detail below.

According to one embodiment, the lift seat 82 is a cushioned seat 82 that provides additional support and other benefits to the user. That is, it is known in the art that airplane seats are not comfortable or healthy for wheelchair-bound individuals. That is, people restricted to wheelchairs typically lose a substantial amount of muscle mass in their buttocks. Those individuals who lack a normal amount of muscle mass benefit from or require additional support provided by the chair or seat in which they are seated. Wheelchairs typically provide such support. Airplane seats, on the other hand, have cushions that are soft and do not provide the necessary support for wheelchair-bound people. Thus, in certain embodiments, the cushioned seat 82 used in the system embodiments described herein can provide the support needed by or beneficial to those individuals using the systems as described herein.

Figure 5A:
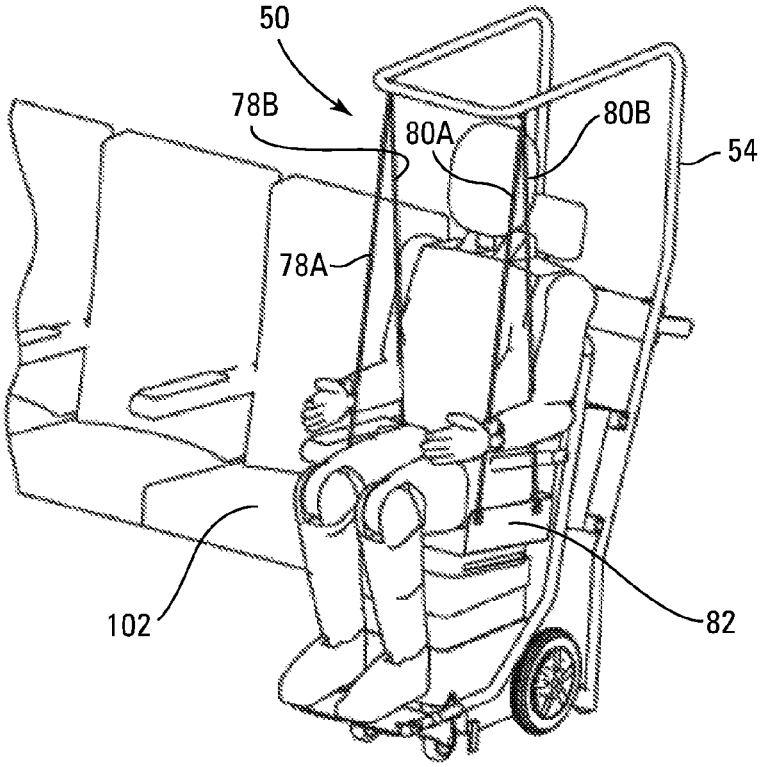
FIG. 5A is a perspective view of the wheelchair system of FIG. 3A being positioned next to an aircraft seat, according to one embodiment.
Figure 5B:
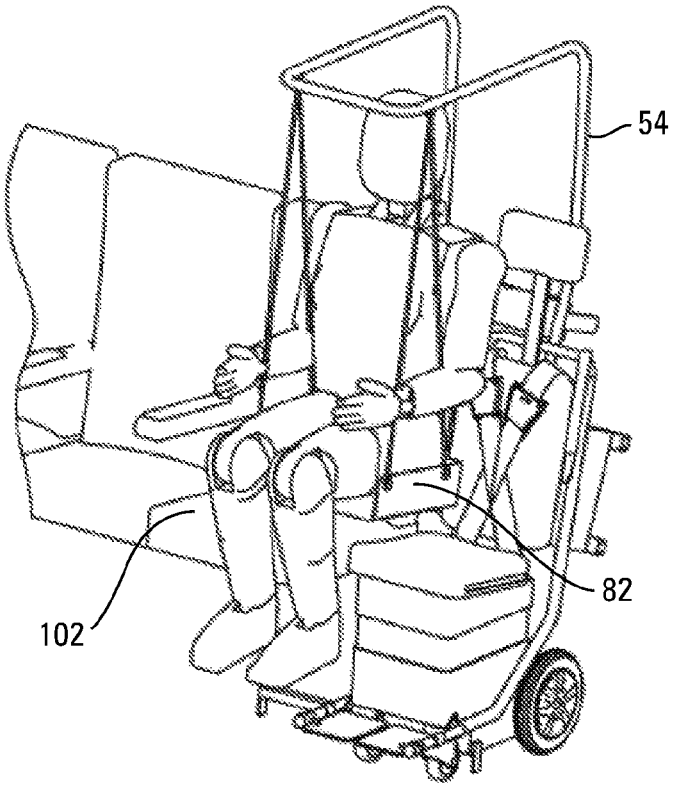
FIG. 5B is a perspective view of the wheelchair system of FIG. 3A being used to transfer a user from the wheelchair system to an aircraft seat, according to one embodiment.
Figure 5C:
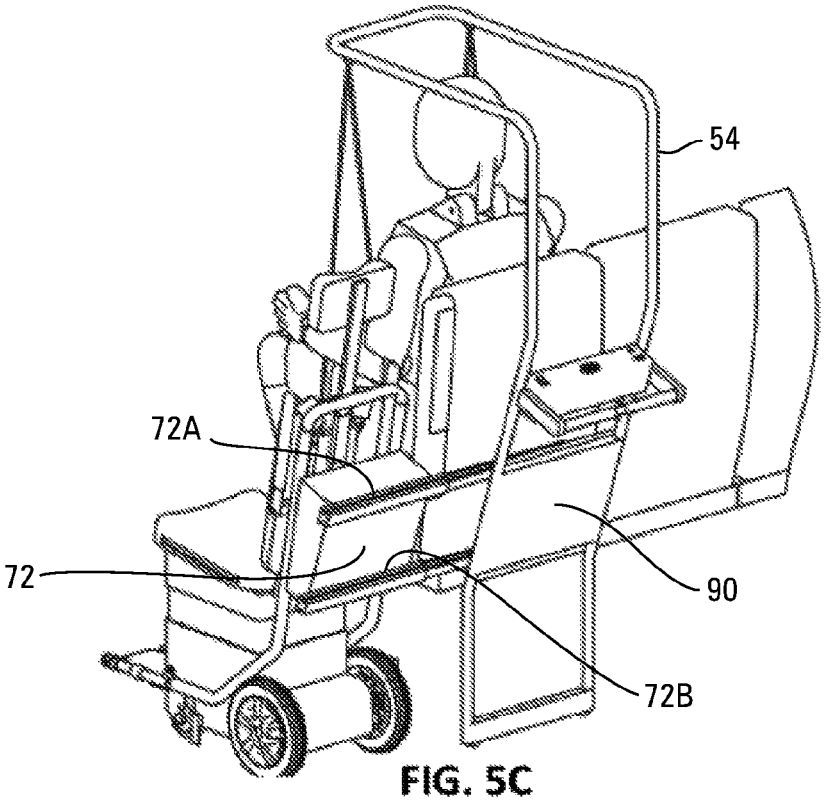
FIG. 5C is a rear perspective view of the wheelchair system of FIG. 3A being used to transfer a user from the wheelchair system to an aircraft seat, according to one embodiment.

The lift system 54 is movably coupled to the chair frame 52 via the mount 72. More specifically, as best shown in FIGS. 3A and 5C, the lift system 54 has a mount coupling component 90 that is slidably coupled to the mount 72 such that the lift system 54 can move laterally or horizontally in relation to the chair frame 52 between an undeployed position as shown in FIGS. 3A-3D and a deployed position in which the lift system 54 has been slidably positioned away from the chair fram 52. The mount coupling component 90 has two rails—an upper coupling component rail (or "lift rail") 90A and a lower coupling component rail (or "lift rail") 90B—that slidably couple with two rails—an upper mount rail 72A and a lower mount rail 72B—on the mount 72 such that the coupling component rails 90A, 90B are coupled with and are slideable in relation to the two mount rails 72A, 72B. Alternatively, it is understood that any known coupling component, mechanism, or system can be used to couple the lift system 54 to the chair frame 52 such that the lift system 54 can be moved laterally in relation to the frame 52. This lateral movement of the lift system 54 between undeployed and deployed positions or configurations makes it possible to transfer a user seated in the lift seat 82 between the chair frame 52 and another seat, such as an airplane seat, as best shown in FIGS. 5A-5E, which will be discussed in further detail below.

According to one embodiment, this system 50 is a dual lift and transfer system 50. That is, as mentioned above, in addition to the lift system 54 described in detail above, the system 50 also has a transfer ramp 62 as best shown in FIG. 3A. In one embodiment, depending on the level of mobility of the mobility-challenged passenger, the passenger can choose whether to be transferred via the lift system 54 as described above or the transfer ramp 62 as described in further detail below.

In use, any of the motorized wheelchair systems discussed or contemplated herein can be used to transport a user onto an aircraft and easily transfer that user into an aircraft seat without the undignified difficulties that wheelchair-bound individuals currently must suffer in order to be positioned in an aircraft seat. The various embodiments of the systems disclosed and contemplated herein are all sized to fit in the aisle of any standard commercial airliner, thereby making it possible to transport a user along the aisle of such aircraft.

In a typical process as shown in FIGS. 4A-5E, a user can be transported through the airport to the airport gate in an airport wheelchair 100, transferred to a motorized wheelchair system such as the system embodiment 50 described above, transported onto the aircraft in the system 50, and transferred from the system 50 to a seat on the aircraft. More specifically, as best shown in FIG. 4A, the user is transported to the gate in the airport wheelchair 100, and the wheelchair system 50 is then positioned next to the airport wheelchair 100. At this point, the lift seat 82 has already been placed under the user (perhaps when the user was first seated on the airport wheelchair 100) or the lift seat 82 is placed under the user at the gate.

Figure 4C:
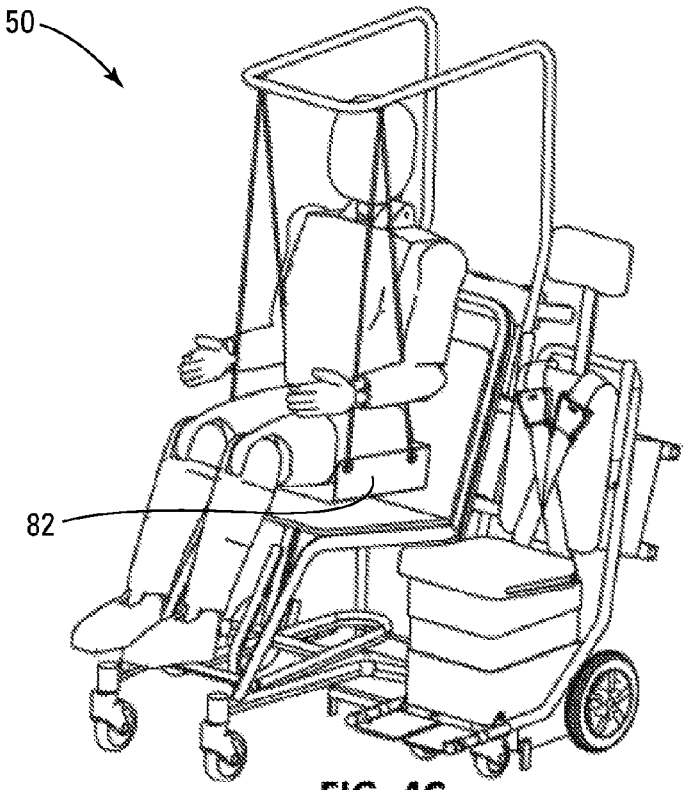
FIG. 4C is a perspective view of the wheelchair system of FIG. 3A being used to transfer a user from a transport chair to the wheelchair system, according to one embodiment.
Figure 4D:
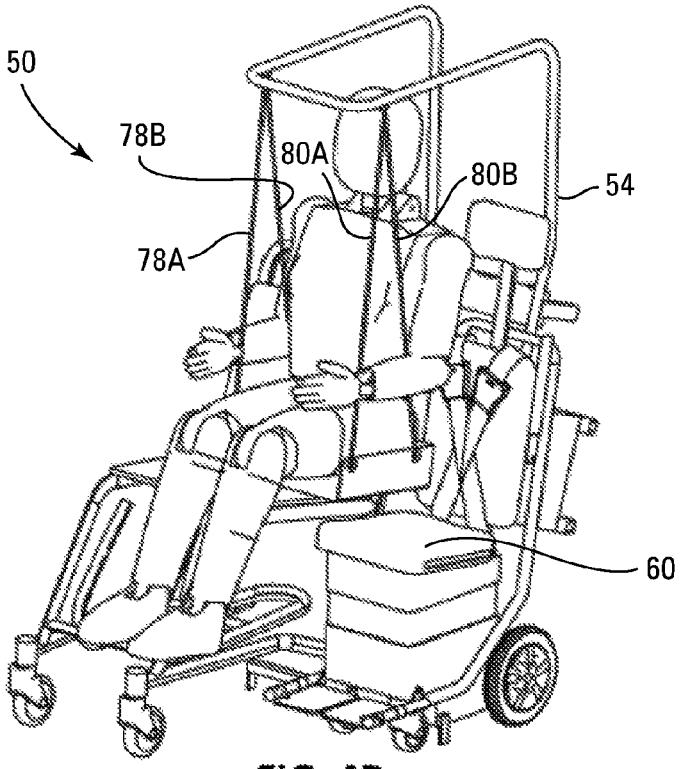
FIG. 4D is a perspective view of the wheelchair system of FIG. 3A being used to transfer a user from a transport chair to the wheelchair system, according to one embodiment.
Figure 4E:
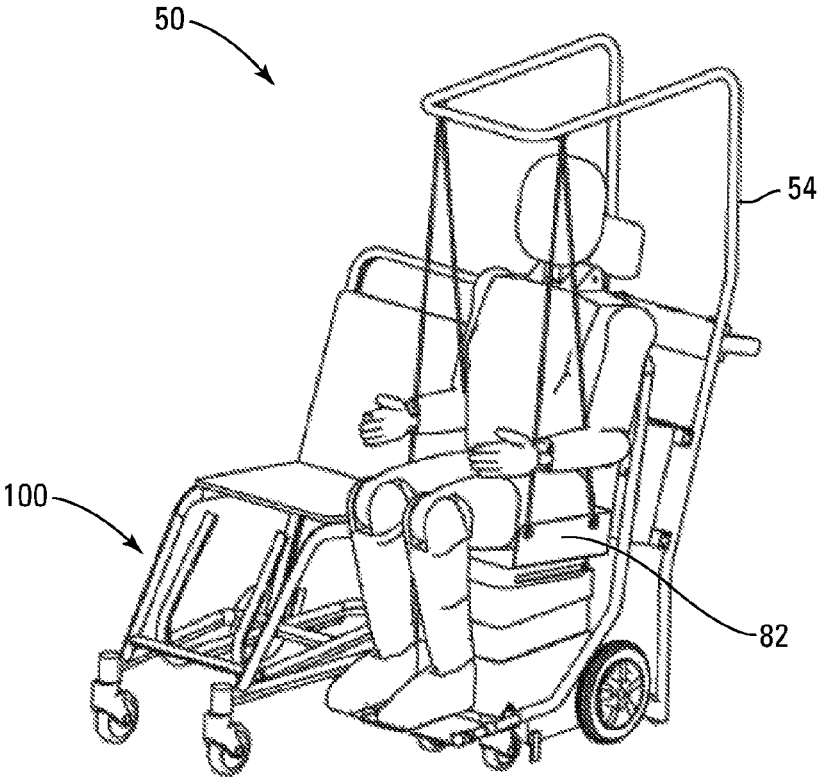
FIG. 4E is a perspective view of the wheelchair system of FIG. 3A being used to transfer a user from a transport chair to the wheelchair system, according to one embodiment.

As shown in FIG. 4B, the lift system 54 is then moved laterally toward the airport wheelchair 100 until the system 54 is positioned directly behind and above the user (the deployed position of the lift system 54), and then the cables 78A, 78B, 80A, 80B are coupled to the lift seat 82 as shown in FIG. 4B. Once the cables 78A, 78B, 80A, 80B are coupled to both the lift seat 82 and the lift system 54, the cables 78A, 78B, 80A, 80B are raised as best shown in FIG. 4C, thereby raising the lift seat 82 and thus the user. Once the lift seat 82 and user are raised to an appropriate height, the lift system 54 is actuated to move back toward its unextended (or "undeployed") position, thereby moving the user toward the seat 60 on the wheelchair system 50 as best shown in FIG. 4D. When the lift seat 82 and user are positioned appropriately above the seat 60, the lift seat 82 is lowered until the lift seat 82 and user are resting on the seat 60 of the system 50 as shown in FIG. 4E. The cables 78A, 78B, 80A, 80B can then be removed (or they can remain in place).

Figure 5D:
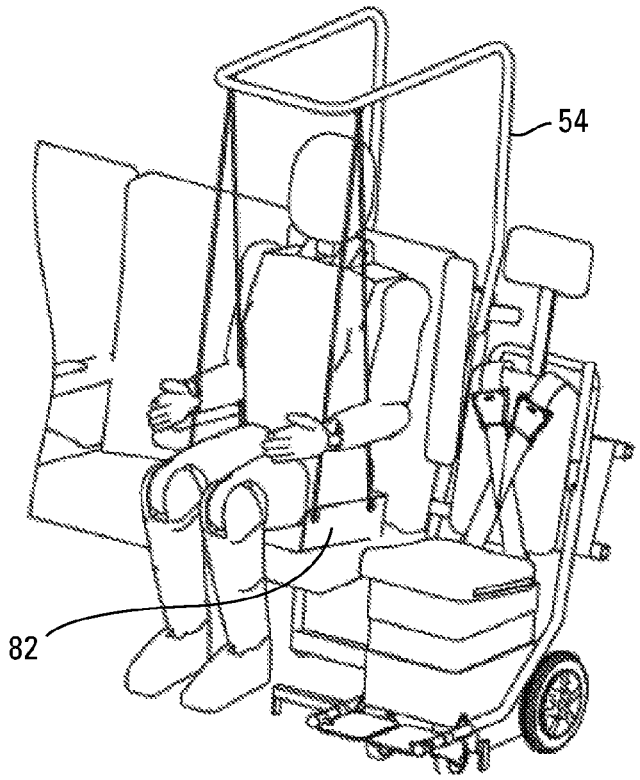
FIG. 5D is a perspective view of the wheelchair system of FIG. 3A being used to transfer a user from the wheelchair system to an aircraft seat, according to one embodiment.
Figure 5E:
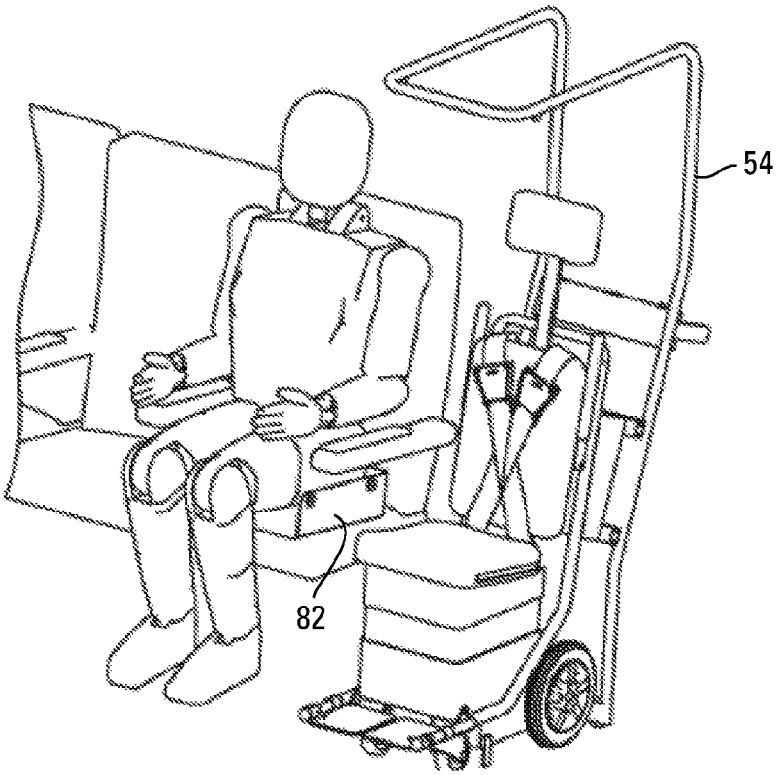
FIG. 5E is a perspective view of the wheelchair system of FIG. 3A positioned next to an aircraft seat after the system was used to transfer a user from the wheelchair system to the aircraft seat, according to one embodiment.

At this point, the user is now positioned on the wheelchair system 50 at the gate. The user can then be wheeled (or can wheel herself) onto the aircraft using the system 50. Once on the plane, the system 50 can be positioned next to the user's aircraft seat 102 as shown in FIG. 5A, with the cables 78A, 78B, 80A, 80B in place (either because they were retained in place or re-installed on the plane). At this point, the cables 78A, 78B, 80A, 80B can be raised, thereby raising the lift seat 82 and the user, and then the lift system 54 is actuated to move laterally toward the aircraft seat 102, thereby moving the lift seat 82 and the user as shown in FIG. 5B. Once positioned above the aircraft seat 102 in the deployed position of the lift system 54 as shown in FIG. 5C, the lift seat 82 is lowered as shown in FIG. 5D. The cables can then be removed and the lift system 54 can be actuated to move back to its unextended or undeployed position as shown in FIG. 5E. At this point, the wheelchair system 50 can be removed from the aircraft. And as discussed elsewhere, the lift seat 82 can either be removed or can remain under the user for comfort and support.

Figure 6:
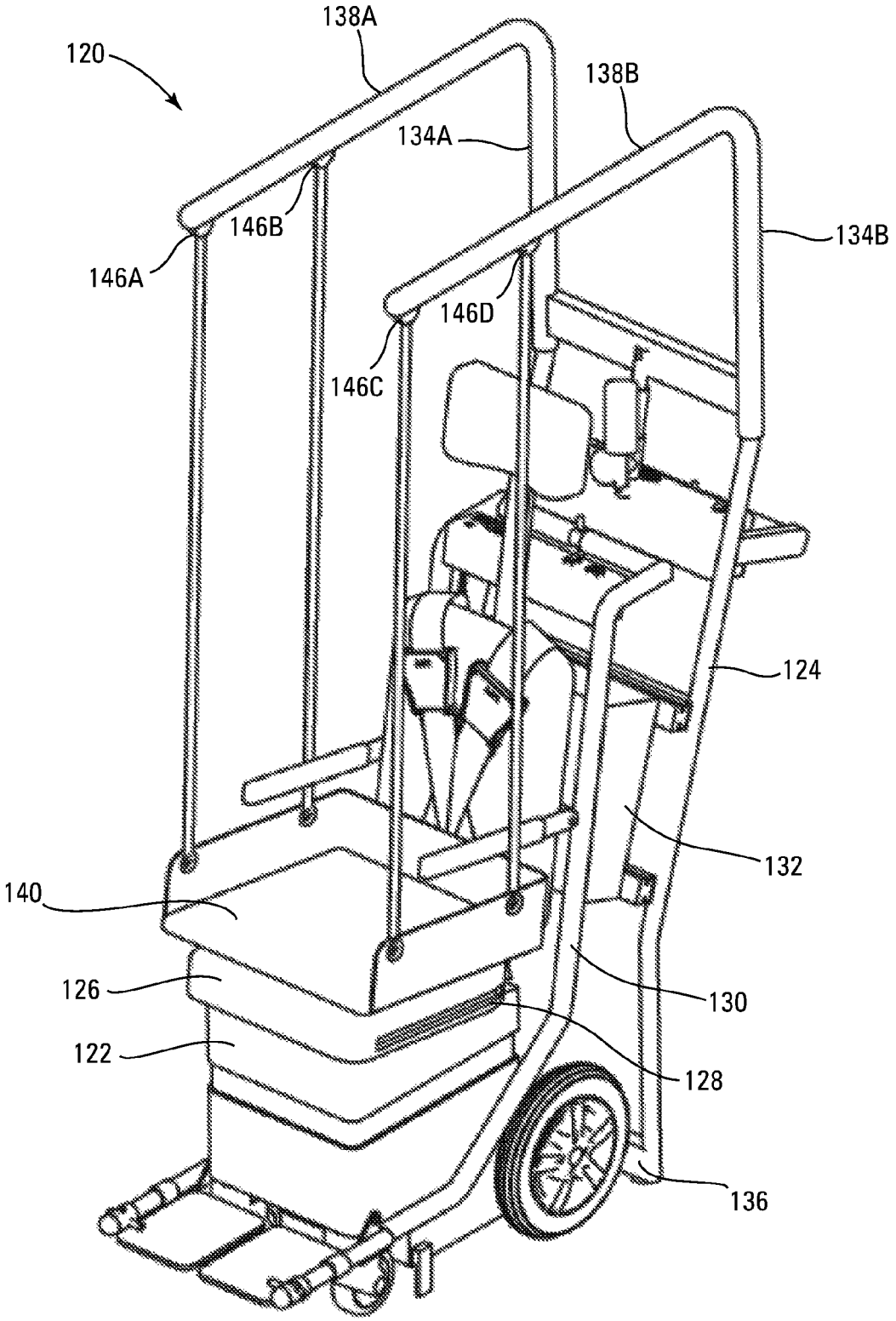
FIG. 6 is a perspective view of a wheelchair system having both a lift system and a transfer ramp, according to one embodiment.

FIG. 6 depicts another implementation of a motorized wheelchair system 120 with a chair 122 and a combination of a lift system 124 and a transfer ramp 128. This exemplary system 120 has several components that are substantially similar to the system 50 discussed above, including a chair seat 126 that contains a retractable transfer ramp 128, a support frame 130 having a lift system mount 132 fixedly coupled to a back portion of the frame 130. Further, the lift system 124 has two substantially vertical rods 134A, 134B, a stabilization component 136 on a bottom portion of the lift 124, and two substantially horizontal support arms 138A, 138B on an upper portion of the lift 124 that extend over the chair 122.

The lift 124 also has a lift seat 140 that can be coupled to the two support arms 138A, 138B via four cables 142A, 142B, 144A, 144B extending between the arms 138A, 138B and the seat 140. The cables 142A, 142B, 144A, 144B are coupled to the arms 138A, 138B via a pulley system 146. Unlike the system 50 described above, in this system 120 embodiment, the pulley system 146 is made up of four pulleys 146A, 146B, 146C, 146D. This pulley system 146 allows for the cables 142A, 142B, 144A, 144B to be pulled toward the arms 138A, 138B (thereby pulling the seat 140 up) or extended away from the arms 138A, 138B (thereby allowing the seat 140 to move downward). Alternatively, the cables 142A, 142B, 144A, 144B can be operably coupled to the arms 138A, 138B via any known mechanism that allows the cables 142A, 142B, 144A, 144B to be coupled to the arms 138A, 138B at four different points such that the cables 142A, 142B, 144A, 144B can be retracted or extended.

It is understood that the wheelchair system 120 can be used to transfer a passenger to and from an aircraft chair in substantially the same fashion as described above with respect to the system 50 having a lift system 54, and also in substantially the same fashion as described elsewhere herein with respect to the system 220 having a transfer ramp 224. It also understood that any of the implementations disclosed or contemplated herein can have any of the lift system embodiments disclosed herein in combination with any of the transfer ramp or transfer belt embodiments disclosed herein. Further, it is also contemplated that certain embodiments can have a combination of a lift system, a transfer belt system, and a transfer ramp.

Figure 7A:
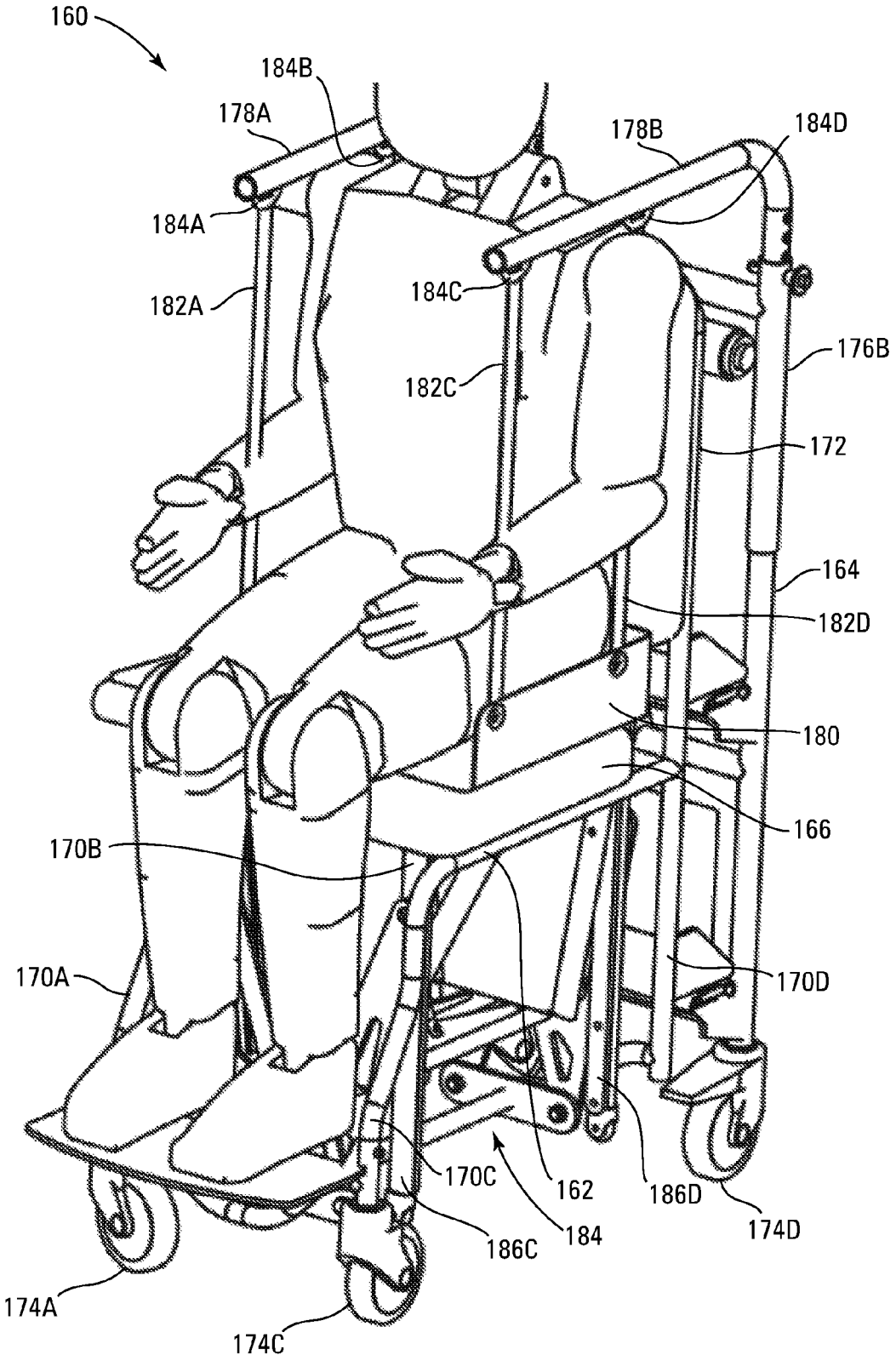
FIG. 7A is a perspective view of a wheelchair system having a lift and transfer system, according to a further embodiment.
Figure 7B:
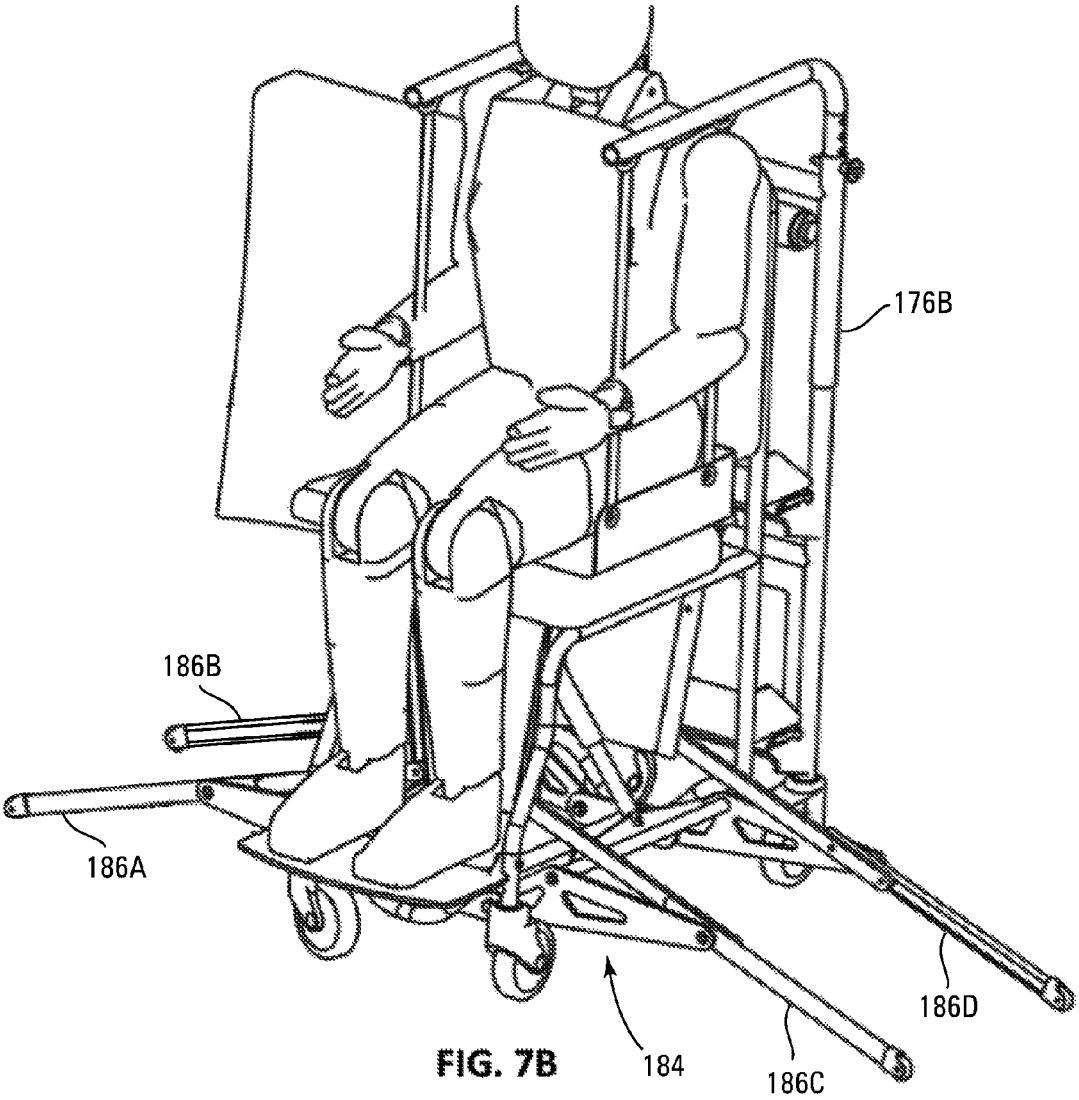
FIG. 7B is a perspective view of the wheelchair system of FIG. 7A, according to one embodiment.
Figure 7C:
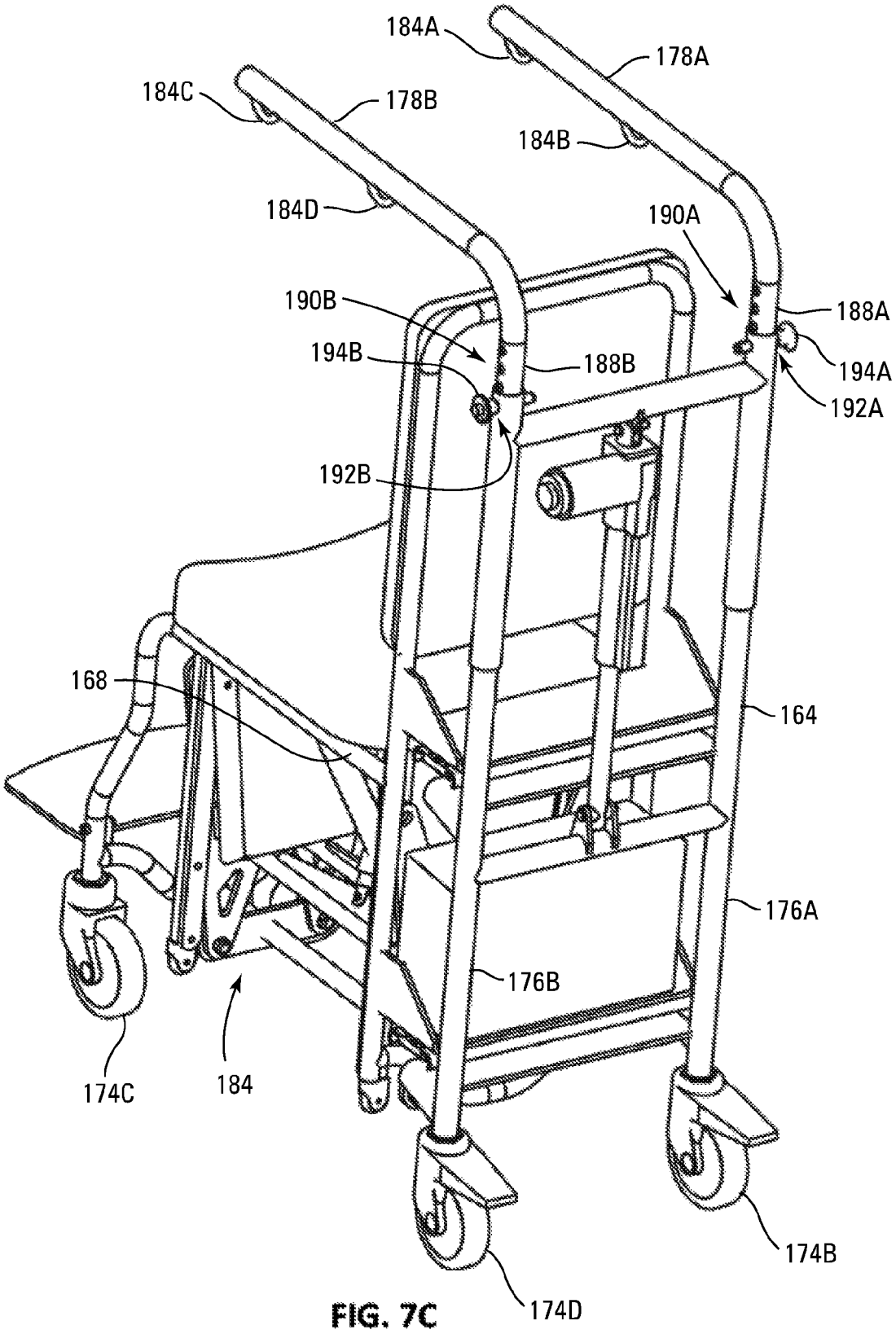
FIG. 7C is a rear perspective view of the wheelchair system of FIG. 7A, according to one embodiment.

FIGS. 7A, 7B, 7C, and 7D depict another implementation of a motorized wheelchair system 160 with a chair frame 162 and a lift system 164. The chair frame 162 has a chair seat 166, four legs 170A, 170B, 170C, 170D, and a chairback 172. The front legs 170A, 170C have swivel wheels (174A, 174C, respectively) rotatably coupled thereto. The frame 162 is slidably coupled to the lift system 164 such that the lift system 164 can move laterally in relation to the frame 162 to transfer the passenger to a chair as described below. The lift system 164 has two substantially vertical rods 176A, 176B with two swivel wheels 174B, 174D rotatably coupled to the bottom of each, as best shown in FIG. 7C. In addition, the lift system 164 has two substantially horizontal support arms 178A, 178B operably coupled to the upper portion of each vertical rods 176A, 176B such that the horizontal arms 178A, 178B extend over the chair frame 162 as shown.

The lift 164 also has a lift seat 180 that can be coupled to the two support arms 178A, 178B via four cables 182A, 182B, 182C (not shown because of the perspective), 182D extending between the arms 178A, 178B and the seat 180. The cables 182A, 182B, 182C, 182D are coupled to the arms 178A, 178B via a pulley system 184, which is made up of four pulleys 184A, 184B, 184C, 184D. This pulley system 184 can be operated in a fashion substantially similar to the system 146 described above. Alternatively, the cables 182A, 182B, 182C, 182D can be operably coupled to the arms 178A, 178B via any known mechanism such that the cables 182A, 182B, 182C, 182D can be retracted or extended.

In one embodiment, the lift system 164 is slidably coupled to the chair frame 162 via coupleable rails like those described above in relation to the system 50 depicted in FIGS. 3A-5E. Alternatively, it is understood that any known coupling component, mechanism, or system can be used to couple the lift system 164 to the chair frame 162 such that the lift system 164 can be moved laterally in relation to the frame 162.

As best shown in FIGS. 7A and 7B, this embodiment also has a stabilization system 184 made up of four stabilization legs 186A, 186B, 186C, 186D that are configured to move between a retracted (or "undeployed") position under the chair seat 166 as best shown in FIG. 7A and an extended (or "deployed") position as best shown in FIG. 7B. In the extended position, each of the legs 186A, 186B, 186C, 186D is positioned in an extended or deployed configuration in which each leg 186A, 186B, 186C, 186D extends outward from the system 160 and contacts the floor. This deployment of the stabilization system 184 provides further stability to the system 160 while a passenger is being transferred to or from an aircraft seat when the lift system 164 is being moved into its deployed configuration, as will be described in further detail below. In one embodiment, as best shown in FIG. 7B, each of the stabilization legs 186A, 186B, 186C, 186D has a wheel operably coupled at the end of the leg as shown. This allows for lateral movement of the system 160 even when the stabilization legs 186A, 186B, 186C, 186D are deployed.

Figure 7D:
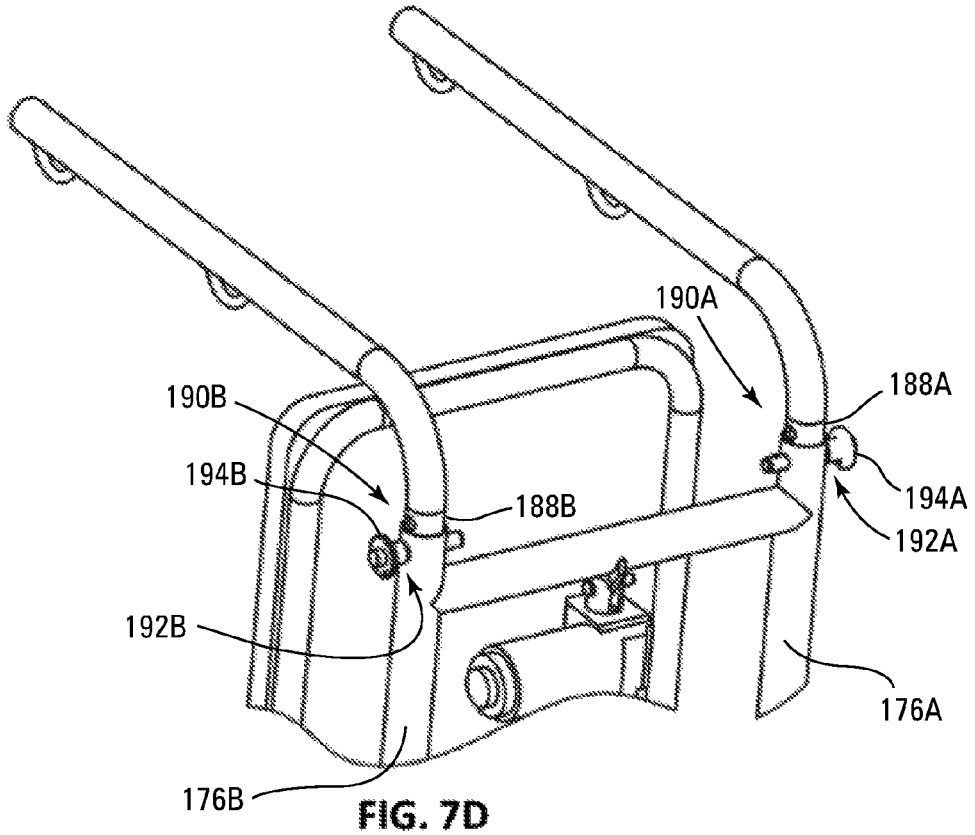
FIG. 7D is a rear perspective view of a portion of the lift system of the wheelchair system of FIG. 7A, according to one embodiment.
Figure 7E:
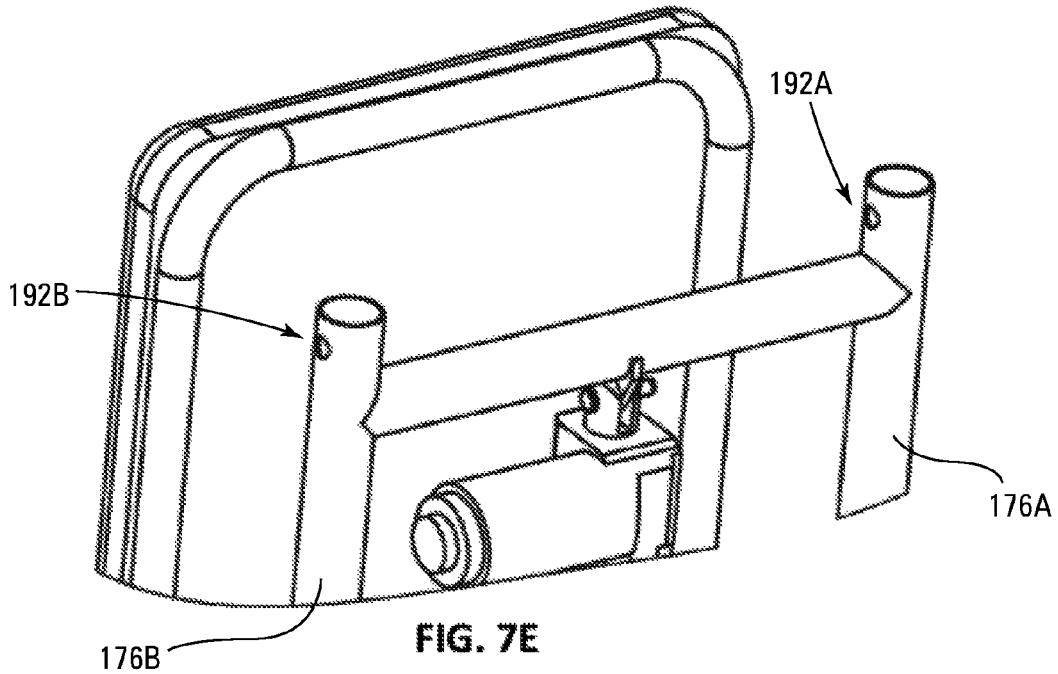
FIG. 7E is a rear perspective view of a portion of the lift system of the wheelchair system of FIG. 7A, according to one embodiment.

As best shown in FIGS. 7A, 7D, and 7E, the support arms 178A, 178B are vertically adjustable, thereby allowing the system 160 to be used to raise the passenger to a variety of heights depending on the dimensions of the aircraft chair, the dimensions of the aircraft, and the possible need to position the passenger over an armrest that cannot be raised. That is, the support arms 178A, 178B are adjustably coupled to the vertical rods 176A, 176B so that the height of the support arms 178A, 178B can be raised or lowered. In this particular embodiment, each of the support arms 178A, 178B has proximal end 188A, 188B that is configured to fit within an opening in the top end of the corresponding vertical rod 176A, 176B. Further, the proximal ends 188A, 188B of the arms 178A, 178B have a series of holes 190A, 190B defined through the ends 188A, 188B that correspond to holes 192A, 192B in the vertical rods 176A, 176B such that a pin 194A, 194B (which can also be a bolt, rod, or other such component) can be positioned through each hole 192A, 192B and the chosen hole amongst the series of holes 190A, 190B to couple the support arms 178A, 178B to the vertical rods 176A, 176B at the desired height.

Figure 8A:
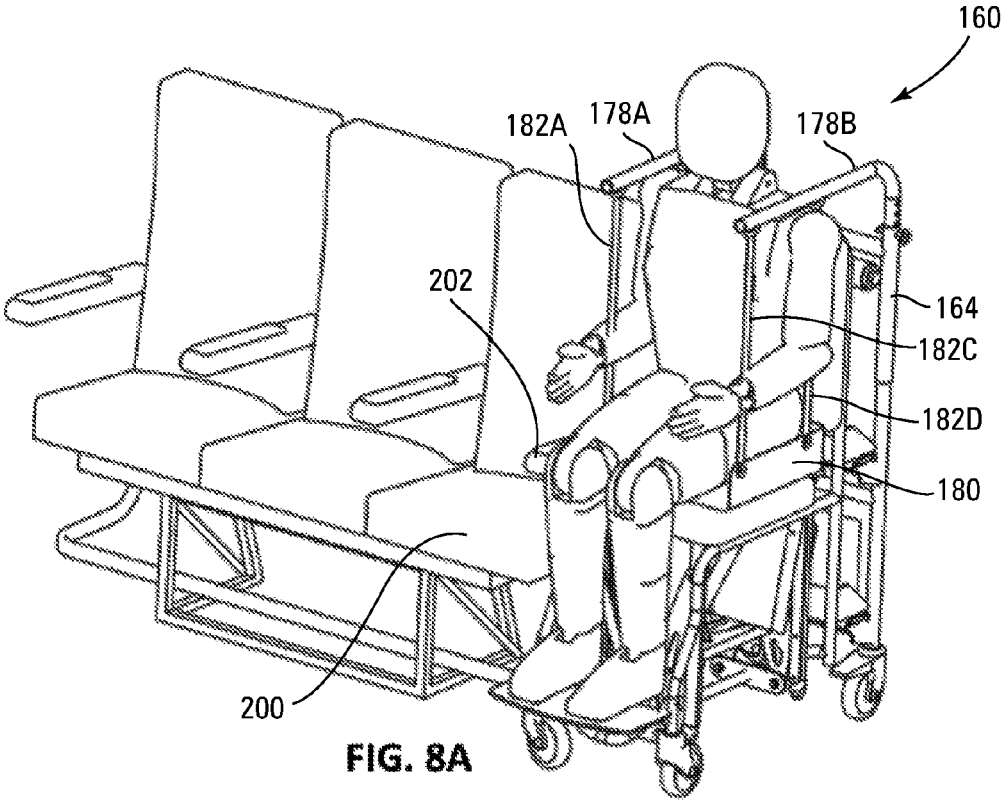
FIG. 8A is a perspective view of the wheelchair system of FIG. 7A being positioned next to an aircraft seat, according to one embodiment.

In use as shown in FIGS. 8A-8F, a user can be transported onto an aircraft in the system 160, and transferred from the system 160 to a seat on the aircraft. More specifically, as best shown in FIG. 8A, the user can then be wheeled (or can wheel herself) onto the aircraft using the system 160. Once on the plane, the system 160 can be positioned next to the user's aircraft seat 200 as shown in FIG. 8A. Prior to moving the system 160 and passenger onto the aircraft, the support arms 178A, 178B can be set at the desired height (depending on various parameters, including, for example, the dimensions of the aircraft and aircraft seat and whether the armrest can be raised). Alternatively, the support arm 178A, 178B height can be set once the system 160 and passenger are positioned on the aircraft.

Figure 8B:
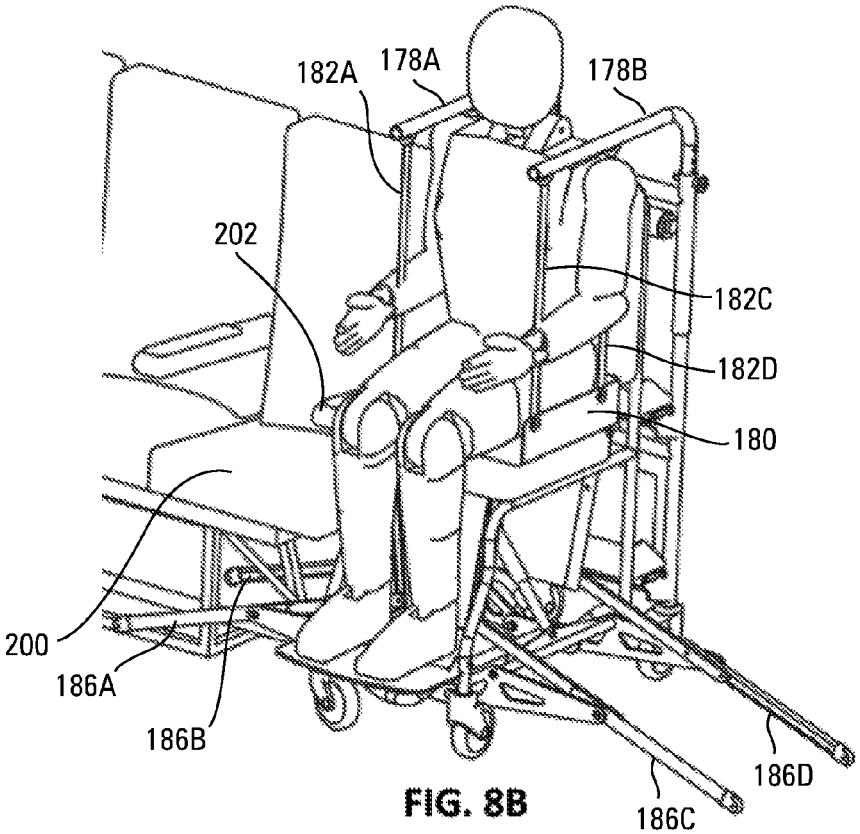
FIG. 8B is a perspective view of the wheelchair system of FIG. 7A in which the stabilization legs have been deployed, according to one embodiment.

Once the system 160 is positioned as desired, in one embodiment the stabilization legs 186A, 186B, 186C, 186D are deployed, as shown in FIG. 8B. That is, the stabilization system 184 is actuated to cause the four stabilization legs 186A, 186B, 186C, 186D to extend from their retracted positions to their deployed positions, thereby providing additional stabilization to the system 160 for purposes of passenger transfer to the seat 200. Alternatively, the stabilization legs 186A, 186B, 186C, 186D need not be deployed if stabilization is not required.

Figure 8C:
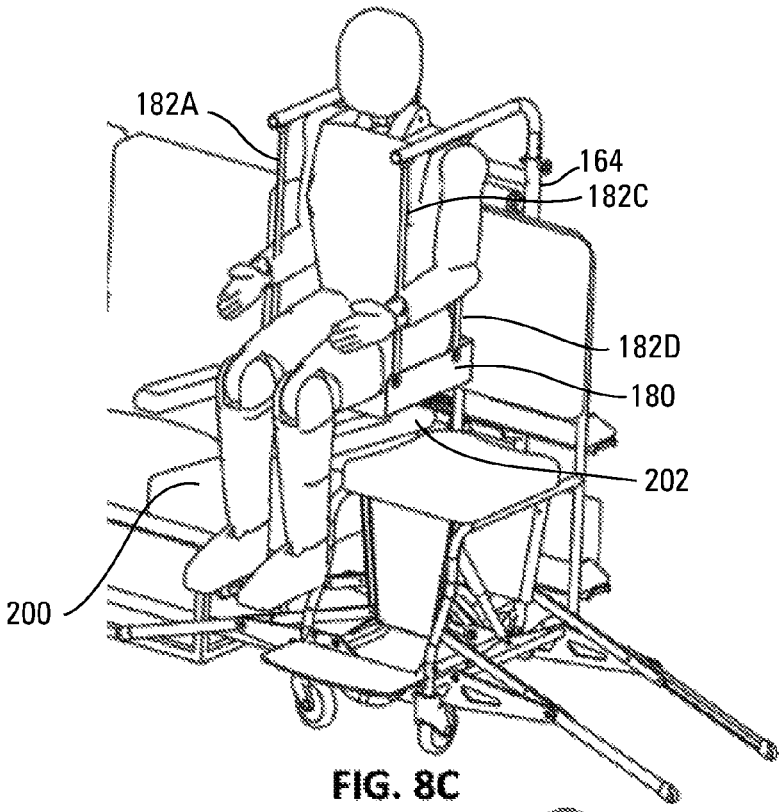
FIG. 8C is a perspective view of the wheelchair system of FIG. 7A being used to transfer a user from the wheelchair system to an aircraft seat, according to one embodiment.
Figure 8D:
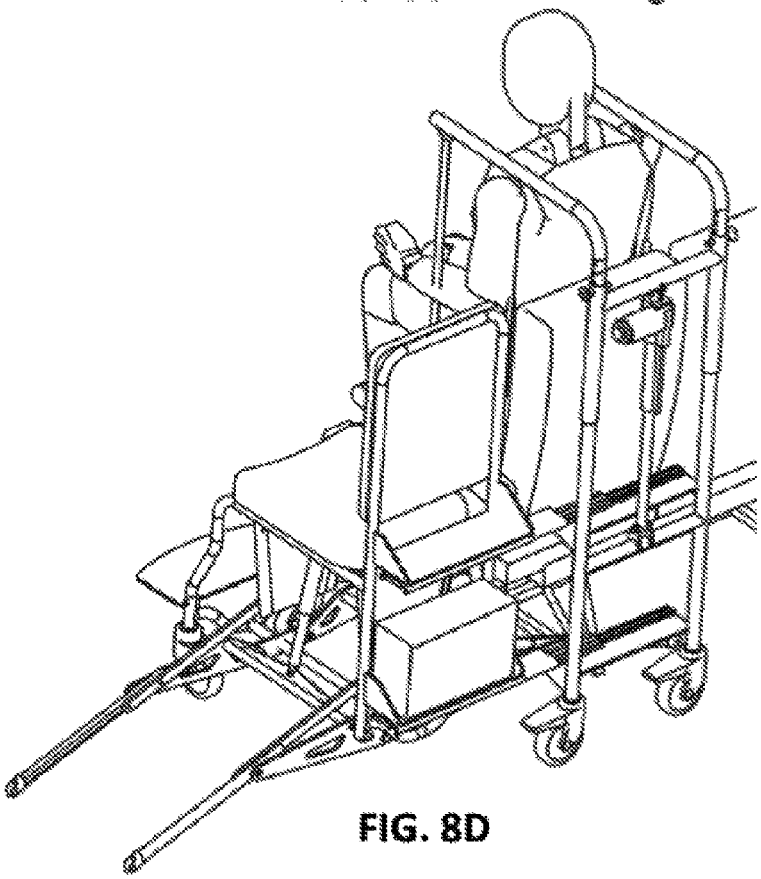
FIG. 8D is a rear perspective view of the wheelchair system of FIG. 7A being used to transfer a user from the wheelchair system to an aircraft seat, according to one embodiment.
Figure 8E:
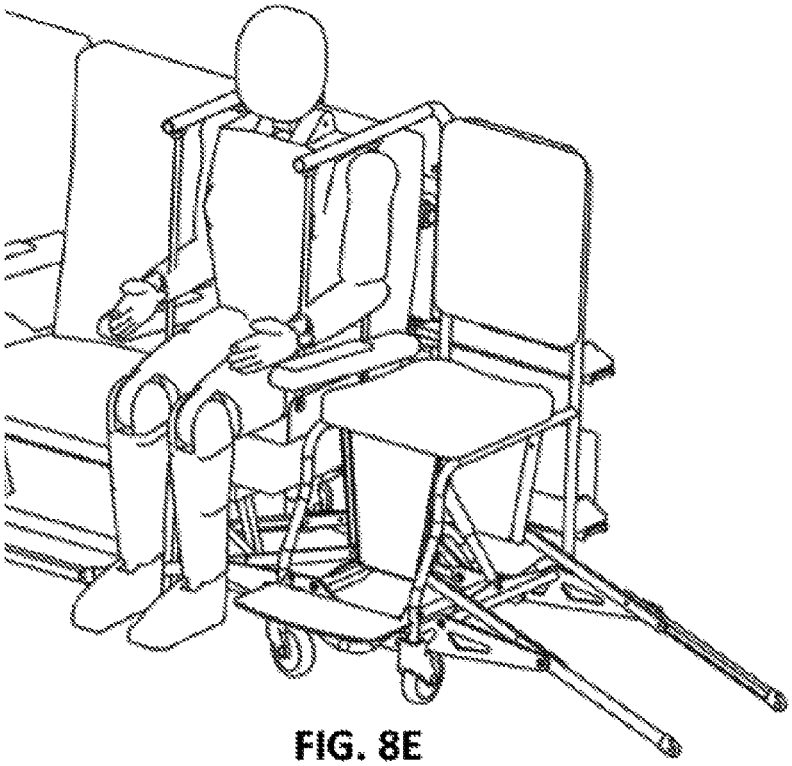
FIG. 8E is a perspective view of the wheelchair system of FIG. 7A being used to transfer a user from the wheelchair system to an aircraft seat, according to one embodiment.
Figure 8F:
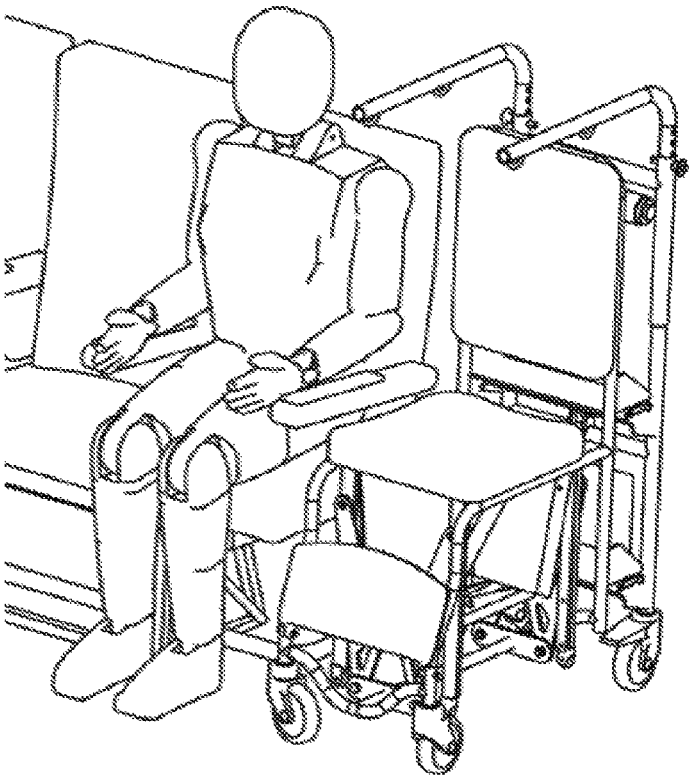
FIG. 8F is a perspective view of the wheelchair system of FIG. 7A positioned next to an aircraft seat after the system was used to transfer a user from the wheelchair system to the aircraft seat, according to one embodiment.

At this point, the cables 182A, 182B, 182C, 182D can be raised, thereby raising the lift seat 180 and the user. Note in this specific example that the left armrest 202 of the aircraft seat 200 cannot be raised, and thus the lift seat 180 must be raised high enough to clear the armrest 202. Once the desired height is achieved, the lift system 164 is actuated to move laterally toward the aircraft seat 200 (and thus toward the deployed position or configuration of the lift system 164), thereby moving the lift seat 180 and the user over the armrest 202 as shown in FIG. 8C. Once the lift system 164 is in its deployed configuration such that the lift seat 180 is positioned above the aircraft seat 200 as shown in FIG. 8D, the lift seat 180 is lowered as shown in FIG. 8E. The cables can then be removed and the lift system 164 can be actuated to move back to its unextended position as shown in FIG. 8F. At this point, the wheelchair system 160 can be removed from the aircraft. And as discussed elsewhere, the lift seat 180 can either be removed or can remain under the user for comfort and support.

Figure 9:
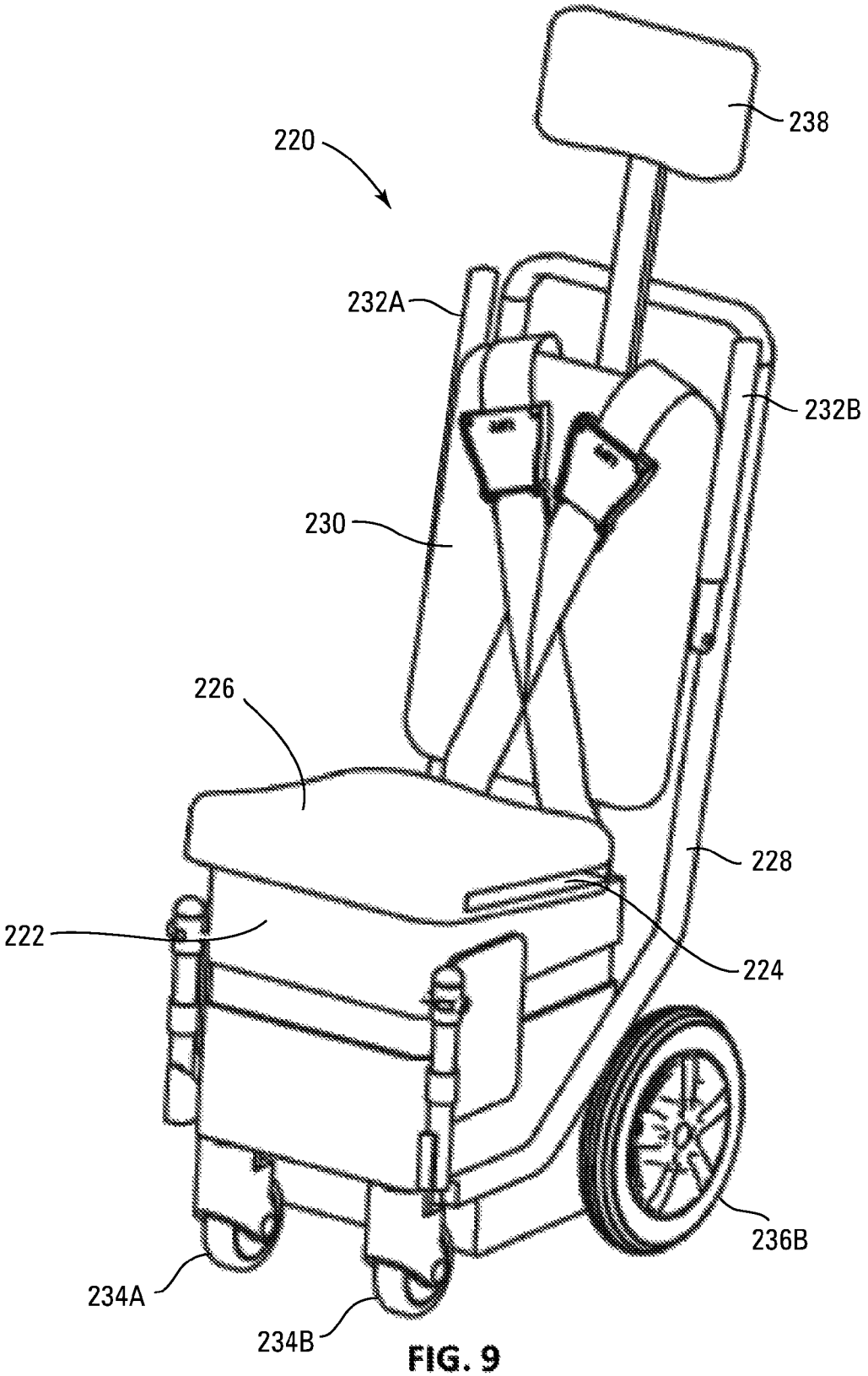
FIG. 9 is a perspective view of a wheelchair system having a transfer ramp, according to another embodiment.

FIG. 9 depicts a motorized wheelchair system embodiment 220 with a transfer ramp 224, similar to the system 30 discussed above (and depicted in FIG. 2). In this implementation, in addition to the ramp 224, the system 220 has a chair 222 with a chair seat 226. The transfer ramp 224 is positioned in a retracted (or "undeployed") position or configuration within the chair seat 226 (or elsewhere on the chair 222) and can be extended out of the chair seat 226 and positioned against or on another seat, such as a seat on an aircraft, in an extended or deployed position or configuration so that a user can be transferred between the chair 222 and the seat, as will be described in further detail below. According to one embodiment, the system 220 with a transfer ramp 224 is used by passengers with greater mobility than those required to use a system with a lift system (such as any of the lift system embodiments disclosed herein).

This system 220, according to one implementation, also has a support frame 228, which supports a seat back 230 and adjustable armrests 232A, 232B. The chair 22 also has a headrest 238. In addition, the chair 222 has two front wheels 234A, 234B and two back wheels 236A, 236B (236A is not depicted in this figure). According to one embodiment, the front wheels 234A, 234B are swivel wheels and the two back wheels 236A, 236B are fixed wheels. Alternatively, any known wheels of any configuration can be used.

Figure 10A:
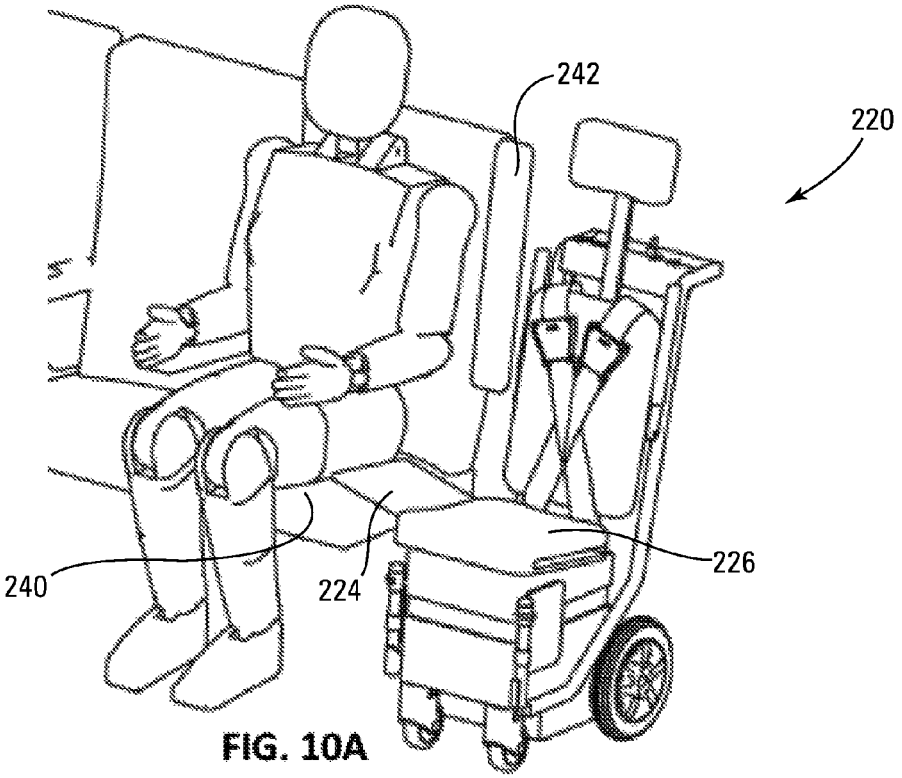
FIG. 10A is a perspective view of the wheelchair system of FIG. 9 being used to transfer a user from an aircraft seat to the wheelchair system, according to one embodiment.
Figure 10B:
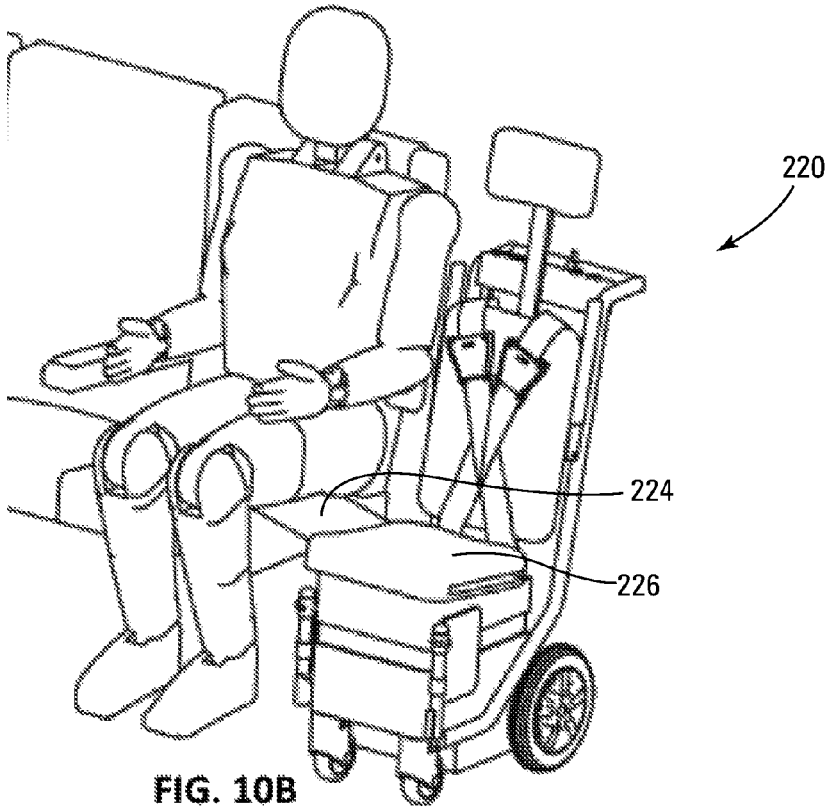
FIG. 10B is a perspective view of the wheelchair system of FIG. 9 being used to transfer a user from an aircraft seat to the wheelchair system, according to one embodiment.
Figure 10C:
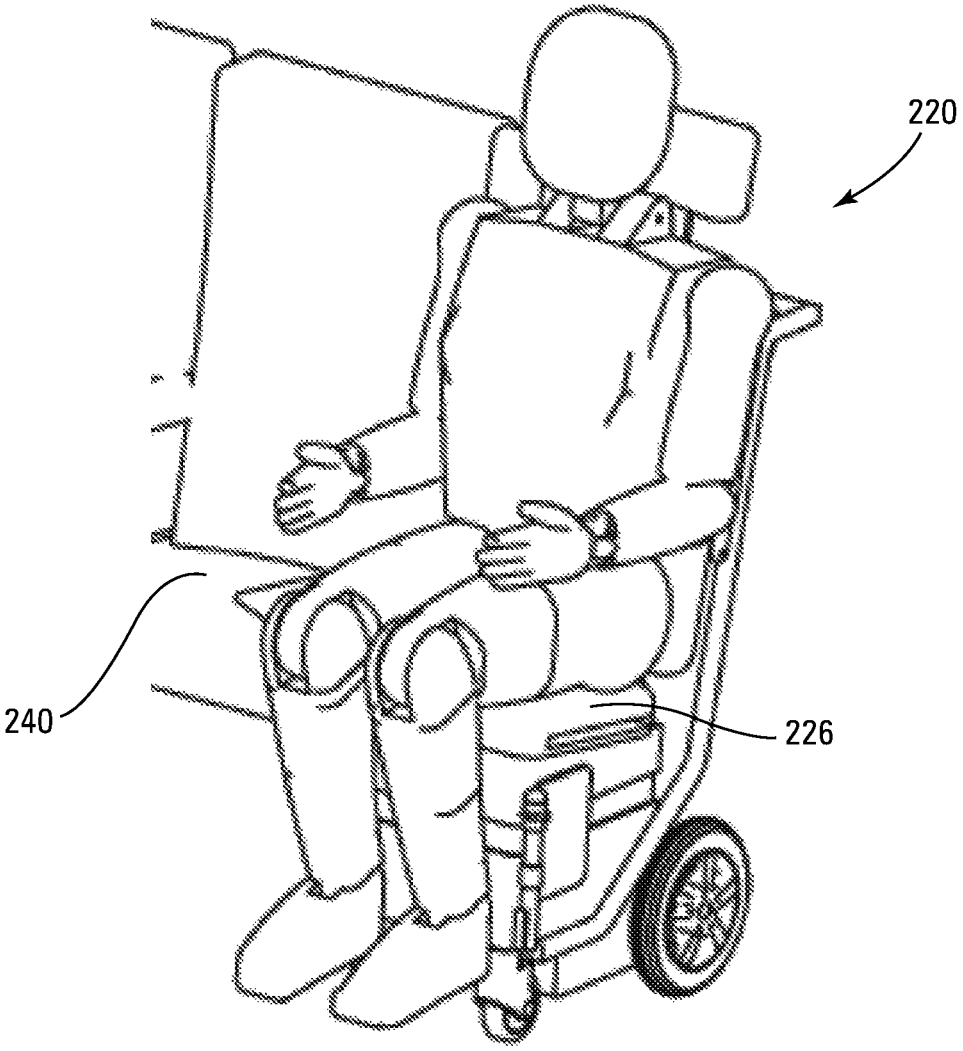
FIG. 10C is a perspective view of the wheelchair system of FIG. 9 being used to transfer a user from an aircraft seat to the wheelchair system, according to one embodiment.

In use, the system 220 and ramp 224 can be used to transfer a user between the seat 226 and another seat, such as an aircraft seat 240 as shown in FIG. 10A. The example of a transfer from an aircraft seat 240 to the wheelchair system 220 will be described herein, but it is understood that the transfer from the system 220 to an aircraft seat works in a similar fashion. First, the system 220 is positioned appropriately next to the aircraft seat 240 as shown in FIG. 10A such that the seat 226 is positioned lower than the aircraft seat 240. After the armrest 242 of the aircraft seat 240 is raised as shown in FIGS. 6A and 6B, the ramp 224 is extended to its deployed position in contact with the aircraft seat 240. As described above, the ramp 224 either has a low-friction surface or a continuous belt to help transport the user. The user is then urged onto the ramp 224 and toward the system 220 as shown in FIG. 10B. The gravity-assisted transfer results in the user being seated in the seat 226 as shown in FIG. 100. Once the user is seated appropriately on the system 220, the ramp 224 can be retracted to its undeployed position.

Figure 11A:
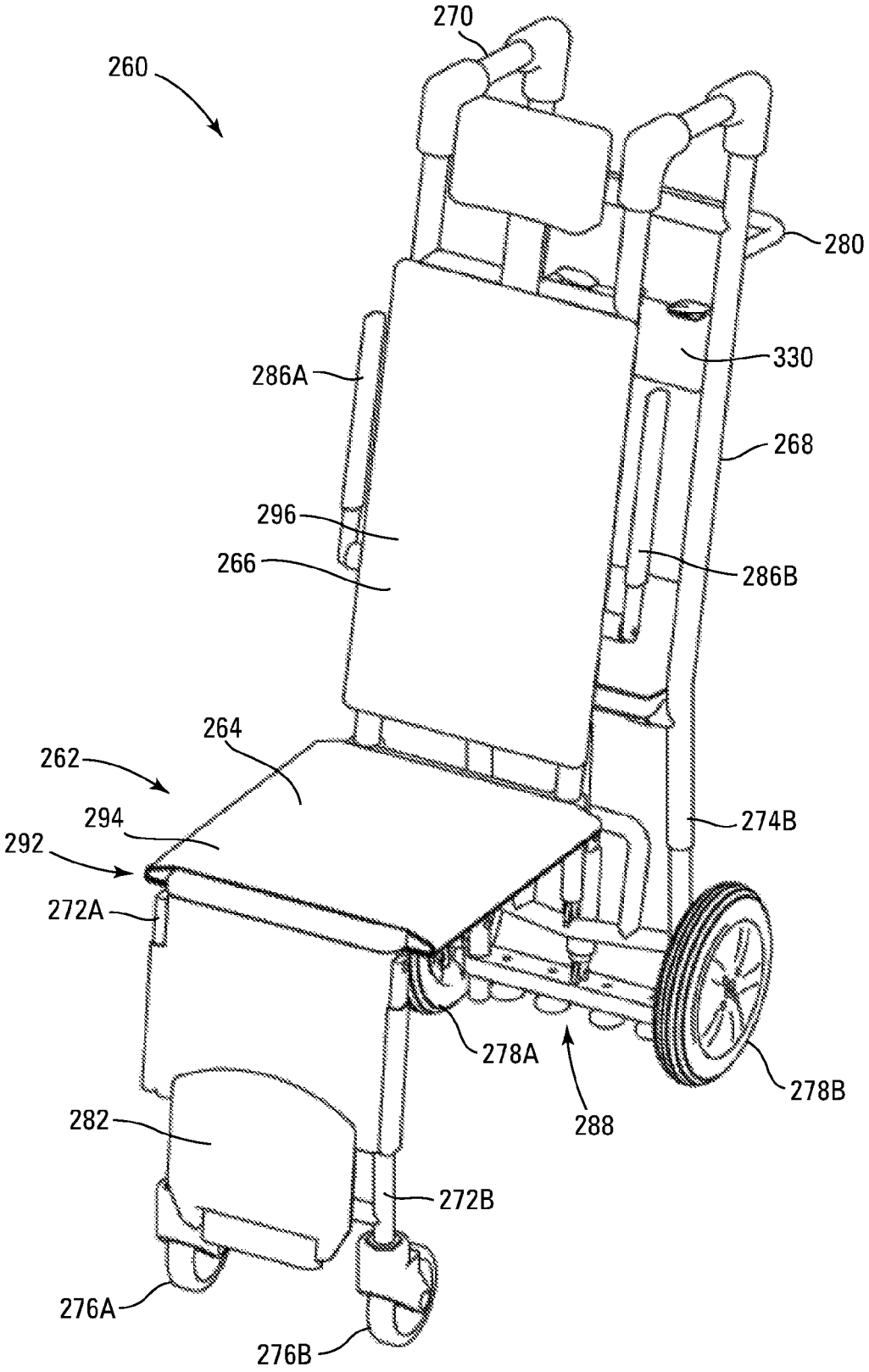
FIG. 11A is a perspective view of a wheelchair system having a transfer belt system, according to one embodiment.
Figure 11B:
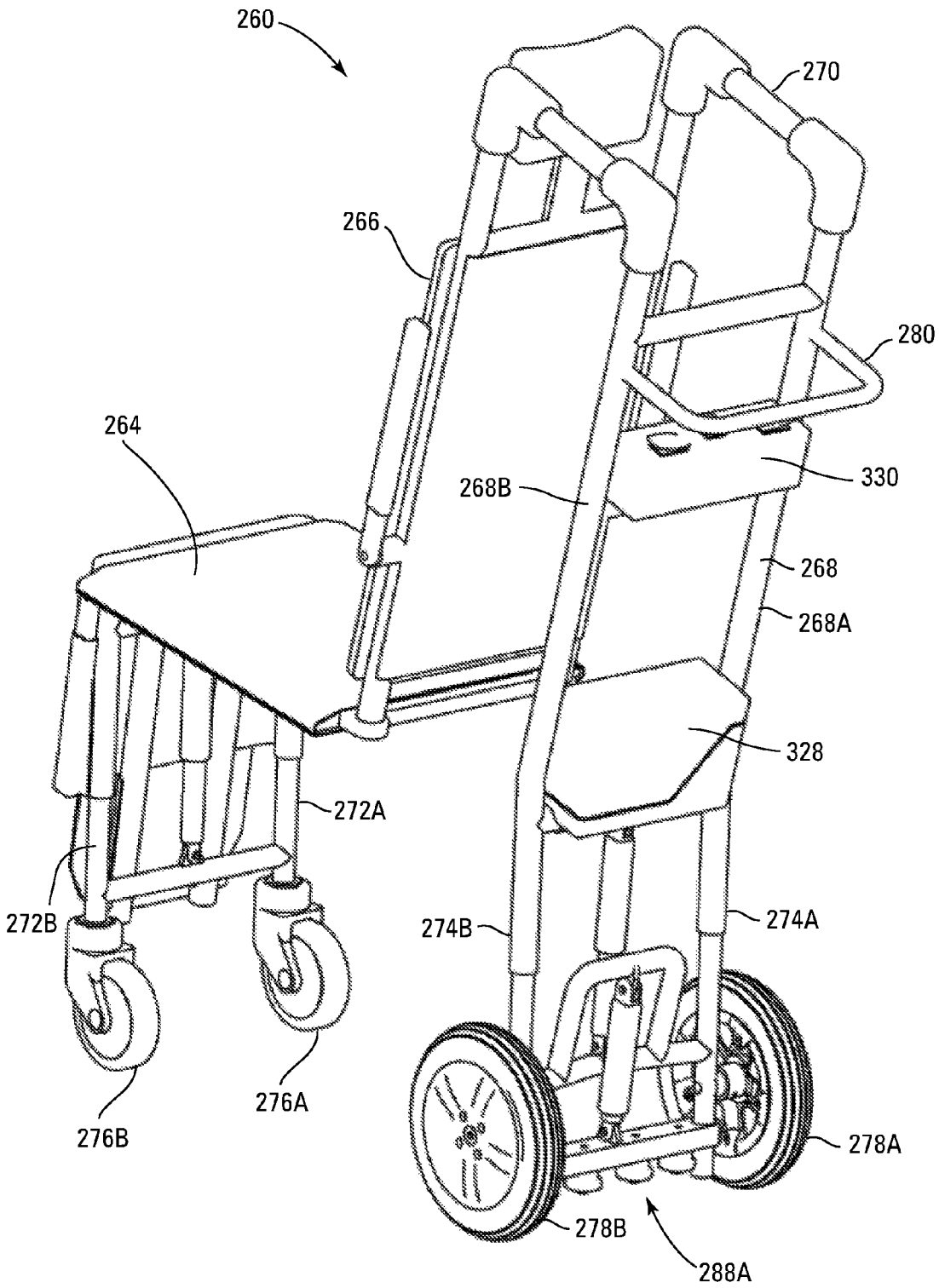
FIG. 11B is a rear perspective view of the wheelchair system of FIG. 11A, according to one embodiment.
Figure 11C:
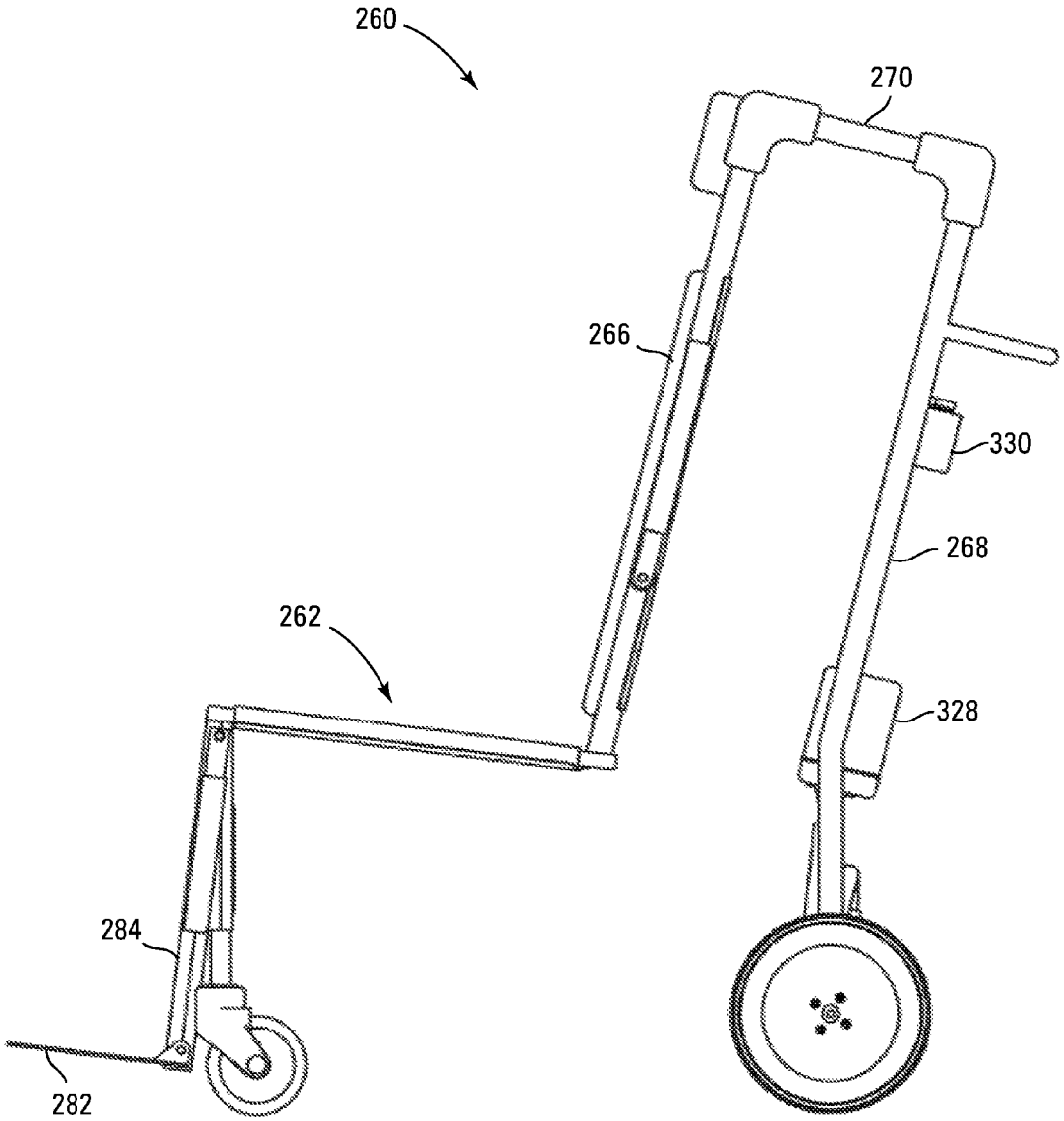
FIG. 11C is a side view of the wheelchair system of FIG. 11A, according to one embodiment.

Another motorized wheelchair system 260 embodiment is depicted in FIGS. 11A-11F. As best shown in FIGS. 11A-11C, this particular system 260 is a chair frame 262 with a seat 264, a seat back 266, a rear frame support 268, and a connector 270 connecting the seat back 266 and rear frame support 268. In one embodiment, the connector 270 is coupled to the seat back 266 at or near a top portion of the seat back 266 and further is coupled to the rear frame support 268 at or near the top portion of the rear frame support 268. According to one embodiment, the rear frame support 268 is made up of two vertical rods 268A, 268B. In addition, the chair frame 262 has two front legs 272A, 272B coupled to the seat 264, and two back legs 274A, 274B coupled to the vertical rods 268A, 268B of the rear frame support 268. In addition, the chair frame 262 has two front wheels 276A, 276B coupled to the two front legs 272A, 272B and two back wheels 278A, 278B coupled to the two back legs 274A, 274B. According to one embodiment, the wheels 276A, 276B, 278A, 278B are lockable wheels that can be locked in position.

One embodiment of the system 260 also has a handle 280 coupled to the rear frame support 268. Further, the chair frame 262 also has a foot rest 282 (or, alternatively, two separate foot rests, each sized to receive one of the user's two feet) coupled to the chair frame 262 with a foot rest connector 284, as best shown in FIG. 11C. In addition, the chair frame 262 in certain implementations can have a deployable set of arm rests 286A, 286B.

Figure 11D:
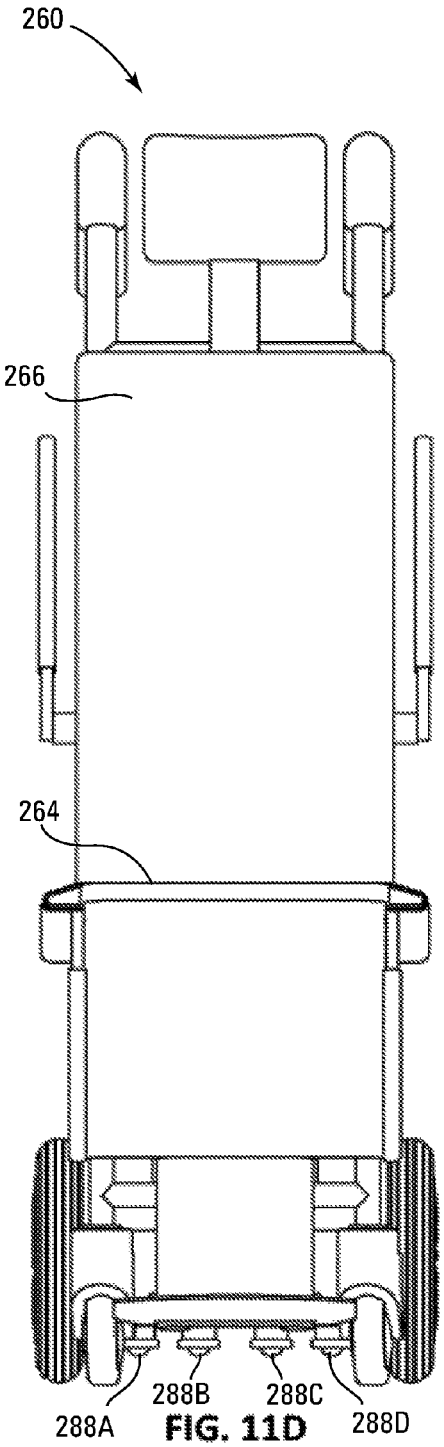
FIG. 11D is a front view of the wheelchair system of FIG. 11A, according to one embodiment.
Figure 11E:
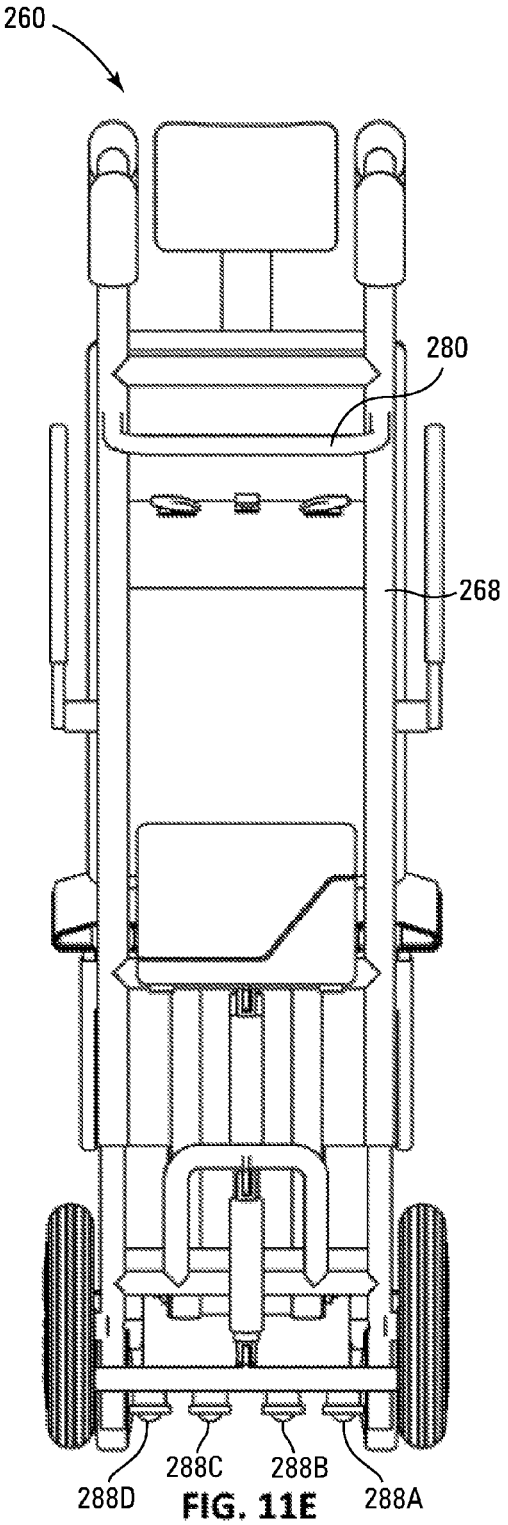
FIG. 11E is a rear view of the wheelchair system of FIG. 11A, according to one embodiment.

The chair frame 262, according to certain implementations, can also have a deployable secondary wheel system 288 positioned between the back wheels 278A, 278B. In this specific embodiment as best shown in FIGS. 11D and 11E, the secondary wheel system 288 is made up of four ball casters 288A, 288B, 288C, 288D. Alternatively, the system 288 can be made up one or more wheels of any kind that can be used as described herein. The system 288 is configured to move between a retracted (or undeployed) position (as shown in FIGS. 11D and 11E) and a deployed (or extended) position in which the wheels 288A, 288B, 288C, 288D are in contact with the floor or other surface on which the system 260 is positioned. In use, as will be described in further detail below, the system 288 is configured to be deployed such that the system 260 can be moved in any direction, including 90 degrees to the direction that the fixed back wheels 278A, 278B allows. In this implementation, the front wheels 276A, 276B are swivel wheels configured to rotate on an axis parallel to the front legs 272A, 272B and thus allow for steering the front portion of the system 260 in any direction, the back wheels 278A, 278B are fixed. Thus, the secondary wheel system 288 can be deployed to move the system 260 sideways over an aircraft seat as described in further detail below. Alternatively, instead of the secondary wheel system 288, the back wheels 278A, 278B can also be swivel wheels, thereby allowing the system 260 to move sideways without the need for the secondary wheel system 288. In a further alternative, any wheel configuration can be used that will allow the system 260 to move sideways as needed.

Figure 11F:
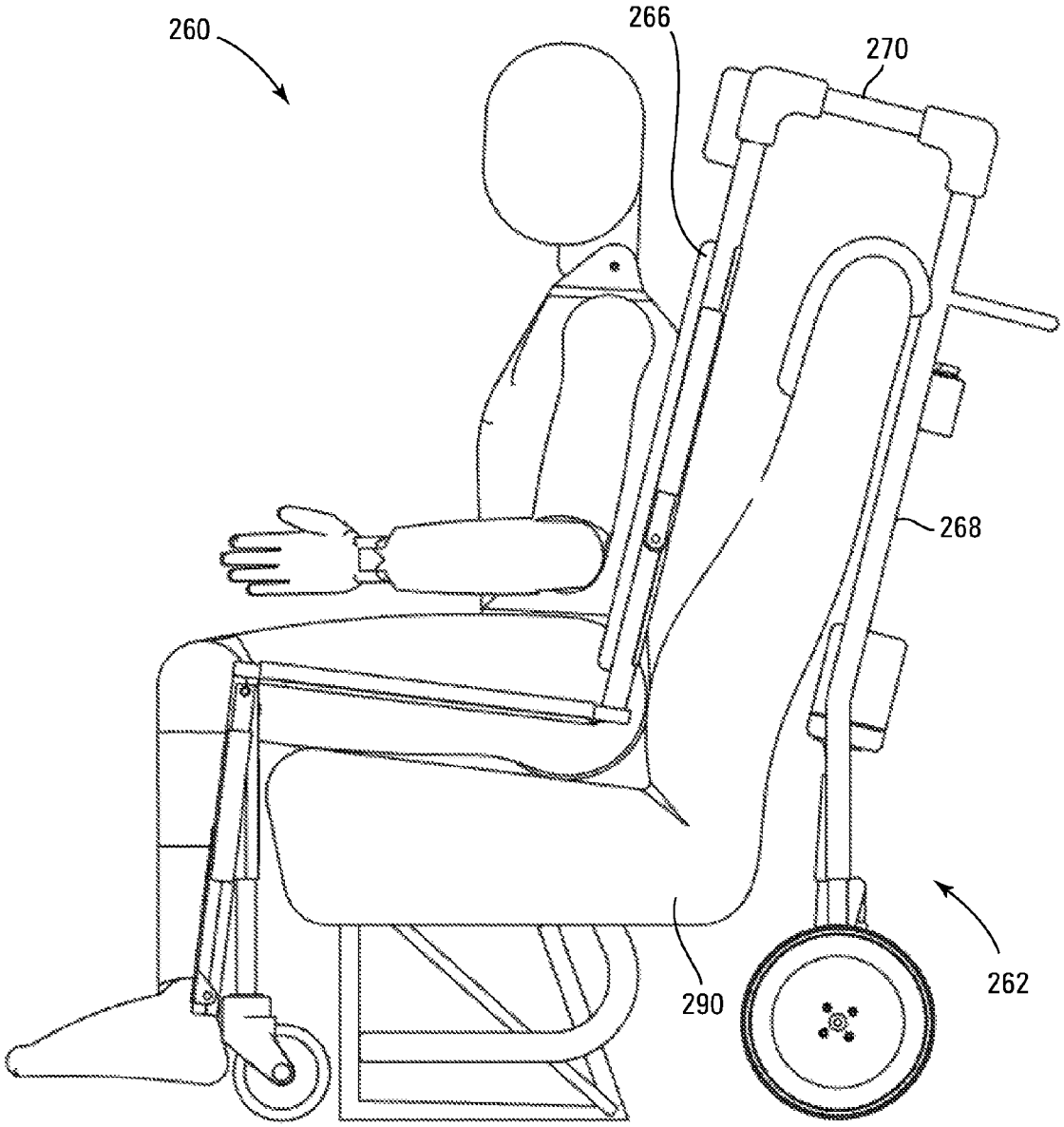
FIG. 11F is a side view of the wheelchair system of FIG. 11A positioned next to or over an aircraft seat, according to one embodiment.

According to one exemplary embodiment as shown in FIG. 11F, the system 260 is sized and configured to be positionable over and around a standard airplane seat 290 such that the seat back 266 is positioned in front of the airplane seat 290 and the rear frame support 268 is positioned behind the airplane seat 290. As such, the connector 270 is positioned above the airplane seat 290 as shown. This allows for the system 260 to be simply and easily pushed onto a plane and then positioned in relation to the user's airplane seat 290 such that the system 260 is positioned over the seat 290. In one alternative implementation, the connector 270 is adjustable such that the depth of system 260 (the distance or space defined between the seat back 266 and the rear frame support 268) can be adjusted to make it possible to position the system 260 over airplane seats (including, for example, seat 290) of various sizes and depths.

Further, as best shown in FIGS. 11A and 11B, the system 260, according to one implementation, has an integrated lateral transfer system 292 that is made up of at least a seat transfer belt system 294 positioned on the seat 264. In this particular embodiment, the system 292 also includes a seat back transfer belt system 296 positioned on the seat back 266. Alternative embodiments have only a seat transfer belt system 294.

Figure 12A:
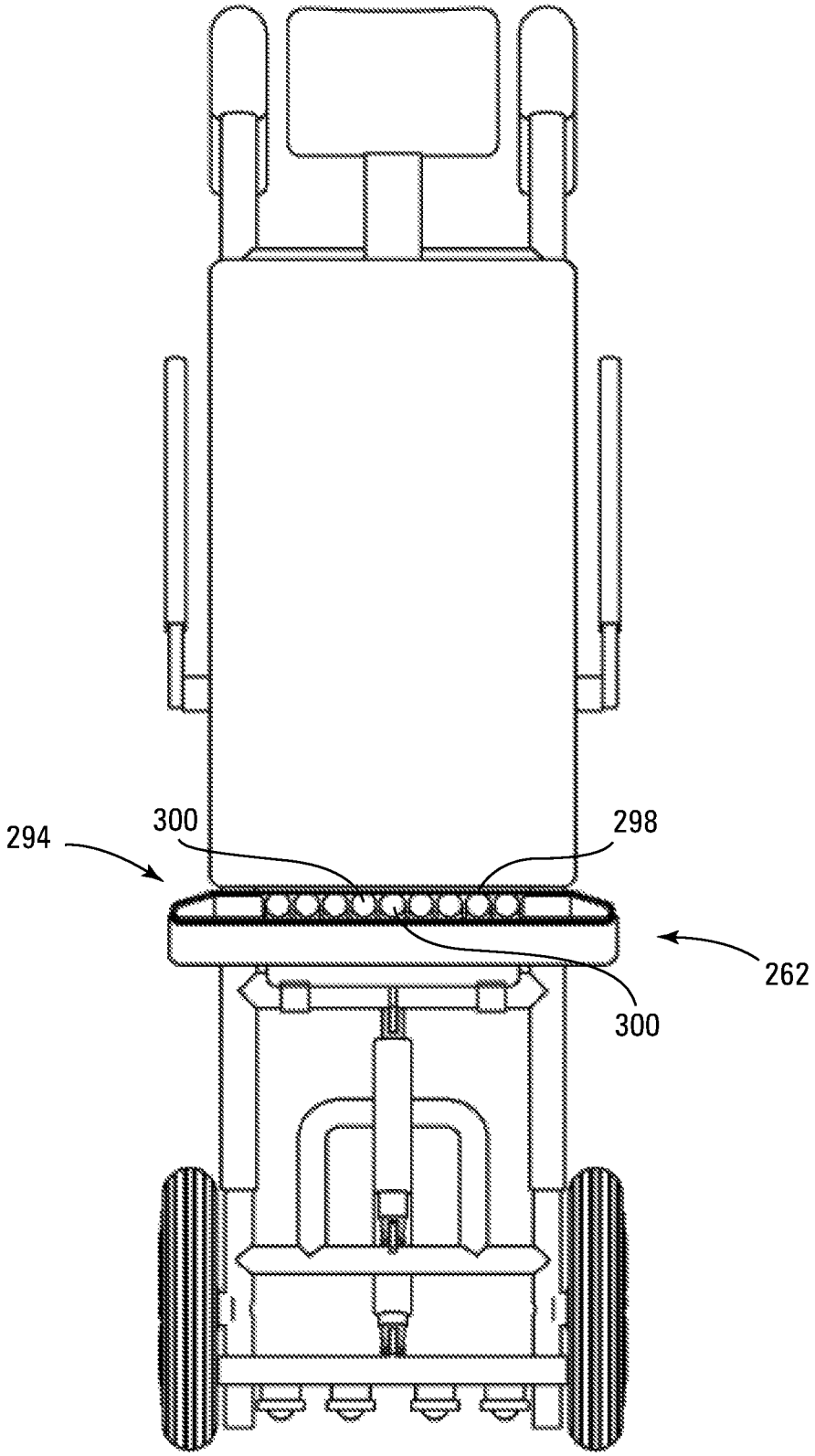
FIG. 12A is a front view of the transfer belt system of the wheelchair system of FIG. 11A, according to one embodiment.
Figure 12B:
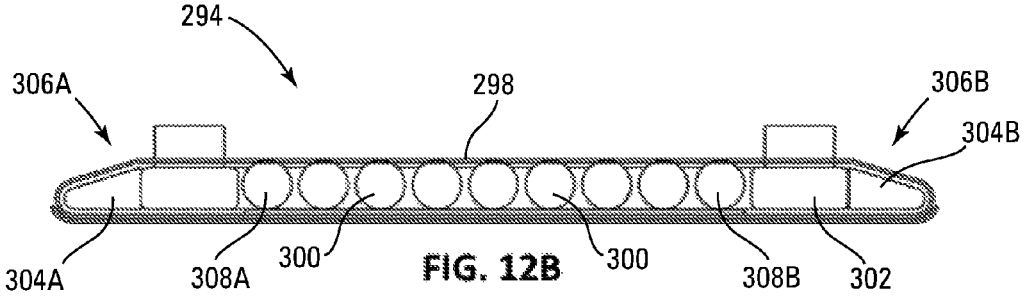
FIG. 12B is a front cross-sectional view of the transfer belt system of FIG. 12A, according to one embodiment.
Figure 12C:
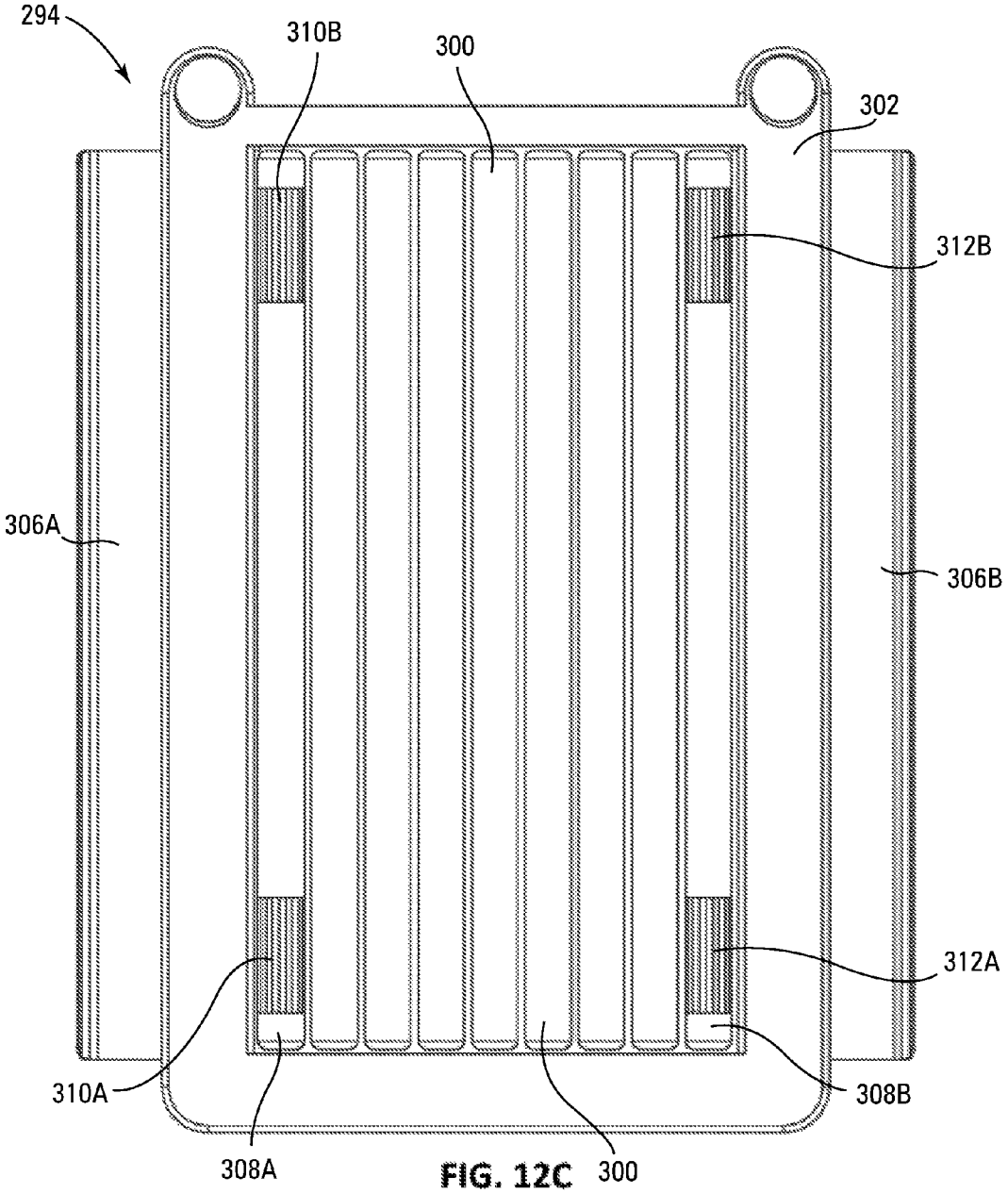
FIG. 12C is a top view of a portion of the transfer belt system of FIG. 12A, according to one embodiment.
Figure 12D:
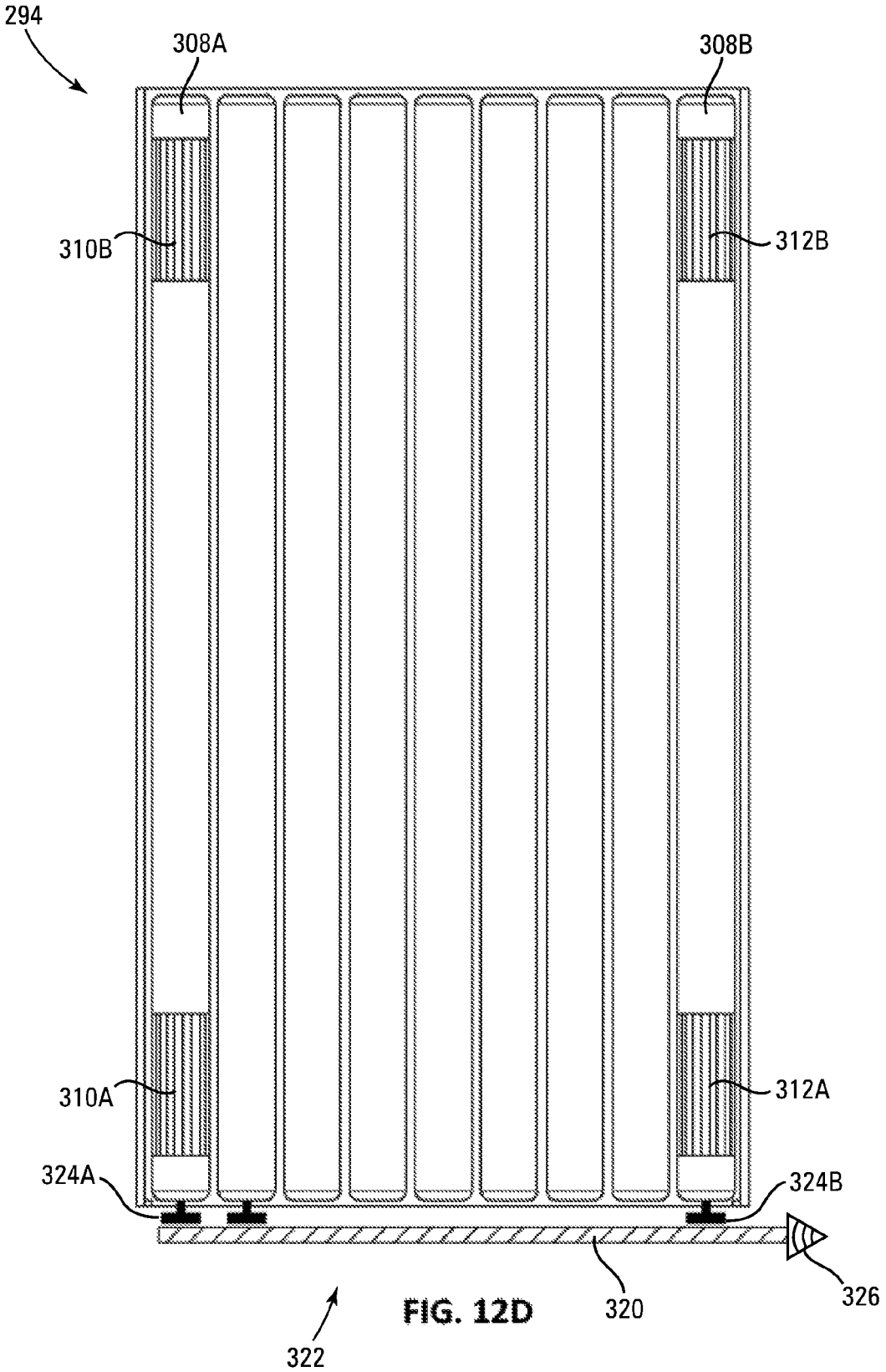
FIG. 12D is a top view of a portion of the transfer belt system of FIG. 12A, according to one embodiment.

FIGS. 12A-12D depict the seat transfer belt system 294 in detail, with FIG. 12A showing a cutaway front cross-sectional view of the belt system 294 on the system 260, FIG. 12B showing a close-up cutaway front cross-sectional view of the system 294, and FIGS. 12C and 12D showing top views of the system 294 with the belt removed. The transfer belt system 294 has a belt 298 positioned on and around a set of central support rollers (also referred to herein as "central rollers" or "support rollers") 300, an internal support component (also referred to as a "support frame" or "internal frame") 302, and two angled end pieces 304A, 304B on each side of the belt system. According to one alternative implementation, the system 294 can also have two internal roller supports (not shown) positioned under the central rollers 300 and coupled at each end to the internal support frame 302. The angled end pieces 304A, 304B create a lip or angled portion 306A, 306B on each side of the belt system 294, both of which are configured to make it easier for a person to slide onto and off of the system 294. The belt 298 is configured to move around the two end pieces 304A, 304B during use when the belt 298 is in motion.

Alternatively, instead of two angled end pieces 304A, 304B, the system 294 can have end support rollers (not shown) (also referred to as "end rollers" or "support rollers") on each side of the belt system 294 that include rollers that are smaller in diameter than the central rollers 300, thereby creating the angled portion 306A, 306B at each side of the belt system 294. In one specific embodiment, the closer each end roller (not shown) is positioned to the end of the system 294 in relation to the rest of the end rollers, the smaller the diameter of such end roller, thereby creating the angled portions 306A, 306B.

In use, as will be described in further detail below, the transfer belt system 294 can be used to transfer the user between the system 260 and another seat.

As best shown in FIGS. 12B, 12C, and 12D the system 294 also has at least one drive roller. More specifically, in this particular embodiment, the system 294 has two drive rollers 308A, 308B that are configured to provide motive force to drive the belt 298. In this implementation, the drive roller 308A has two threaded sections 310A, 310B at each end of the roller 308A that are configured to coupled with threaded sections (not shown) on the surface of the belt 298 that contacts the rollers 300 and the angled end pieces 304A, 304B. As such, actuation of the drive roller 308A to rotate will cause that rotation to be translated into actuation of the belt 298 via the threaded sections 310A, 310B that are coupled to the threads (not shown) on the belt 298. Alternatively, the threaded sections 310A, 310B and corresponding threaded sections on the belt 298 can be toothed or have any other known mechanism that allows for coupling the drive rollers 308A, 308B to the belt 298. Similarly, in this embodiment, drive roller 308B has two threaded sections 312A, 312B that can operate in the same fashion as the threaded sections 310A, 310B of drive roller 308A as discussed above. Alternatively, the system 294 can have only one drive roller or can have three or more drive rollers.

In one implementation as best shown in FIG. 12D, the drive rollers 308A, 308B are actuated in the following manner. A threaded rod 320 is provided that is positioned at the "front" 322 of the system 294 such that it is positioned adjacent to one end of each of the central rollers 300. The drive rollers 308A, 308B each have a gear 324A, 324B (such as a pinion gear, for example) positioned at the end of each roller 308A, 308B near the front 322 of the system 294 such that the threaded rod 320 can be coupled with the gears 324A, 324B. In this embodiment, the threaded rod 320 has a gear 326 (such as a bevel gear 326, for example) at one end that is coupled to a rod or other component (not shown) that is operably coupled to a motor (not shown) mounted somewhere on the system 260. In one embodiment, the motor is the motor 328 discussed elsewhere herein and shown in FIG. 11B. Further, according to one implementation, any central roller 300 (or end roller, in certain alternative embodiments) in the system 294 can be configured to have a gear such that the rod 320 can be coupled thereto, thereby making any such roller 300 into a drive roller. As such, certain alternative embodiments of the system 294 can have one, two, three, or more drive rollers.

In one embodiment, the transport system 294 is lockable such that some or all of the rollers 300, 308A, 308B and/or the belt 298 can be actuated by a user to be held or otherwise maintained in a fixed position. It is understood that any known mechanism for locking the belt 298 and/or the rollers 300, 308A, 308B can be used. Further, the transport system 294 in this implementation is reversible such that the belt 298 can be actuated to move in either direction, thereby making it possible to allow the user to be moved in either direction by the belt 298.

As mentioned above, the integrated lateral transfer system 292 also has a seat back transfer belt system 296 positioned on the seat back 266, as best shown in FIGS. 11A-11C. It is understood that this transfer system 296 is positioned on the seat back 266 and is made up of components substantially similar to those described above in relation to the seat transfer belt system 294. According to one embodiment, the seat transfer belt system 294 and the seat back transfer belt system 296 can be operably coupled in any known fashion such that both systems 294, 296 move at the same speed and/or can be powered by the same power source. Further, the overall system 260 can also have a lateral transport system on the foot rest 282 and/or such a transport system positioned to replace or be used in conjunction with the foot rest connector 284 such that the transport system contacts the user's calves.

According to one implementation, the belt 298 is made any known strong material that can withstand the forces being applied to such a device, such as the materials in transport belts used for industrial or agricultural purposes.

In accordance with one embodiment, the seat 264 on which the transfer system 294 is positioned has a top surface that is smoothed or otherwise processed or treated to reduce the amount of friction between the belt 298 and the top surface such that any hindrance to the movement of the belt 298 caused by the top surface of the seat 264 is minimized.

In certain embodiments, the system 260 can also be configured such that the height of the chair frame 262 can be adjusted—that is, the chair frame 262 can be raised or lowered. In one specific implementation, the legs 272A, 272B, 274A, 274B are comprised of nested tube sections, overlapping tube sections, or other types of tubular components that are configured to allow the legs 272A, 272B, 274A, 274B to be extended or retracted via actuators (not shown) such that the chair frame 262 can be raised or lowered. According to one example, the chair frame 262 can be raised or lowered approximately 4 to 6 inches. Other amounts are also contemplated. This height adjustment capability can be combined with the adjustment capability of the connector 270 discussed above to ensure that the system 260 can be positioned over any airplane seat of any size.

As best shown in FIGS. 11B and 110, the system 260 can also have at least one motor 328 coupled to the chair frame 262. In this specific embodiment, the motor 328 is coupled to at least one of the back legs 274A, 274B. The motor 328 can also have one or more batteries coupled thereto. In one embodiment, the motor 328 is operably coupled to the lateral transport system 292. In addition, the motor 328 can also be coupled to the actuators that actuate the extension and retraction of the chair legs 272A, 272B, 274A, 274B to adjust the height of the chair frame 262. Alternatively, a separate motor can be provided for each of the separate transfer systems 294, 296 (including any transfer system associated with the foot rest 282 and/or the foot rest connector 284) and for any actuators (not shown) associated with the legs 272A, 272B, 274A, 274B for purposes of extension and retraction.

In accordance with one implementation, the system 260 can also have a handheld controller (either a remote or a wired handheld controller) (not shown) to control the transfer systems 294, 296 (including any foot rest or foot rest connector transfer systems) and/or the leg actuators (not shown) or any other actuators incorporated into the system 260. Alternatively, a controller 330 with actuation buttons can be provided that is coupled to at least one of the back legs 274A, 274B as shown in FIGS. 11A-110.

Figure 13A:
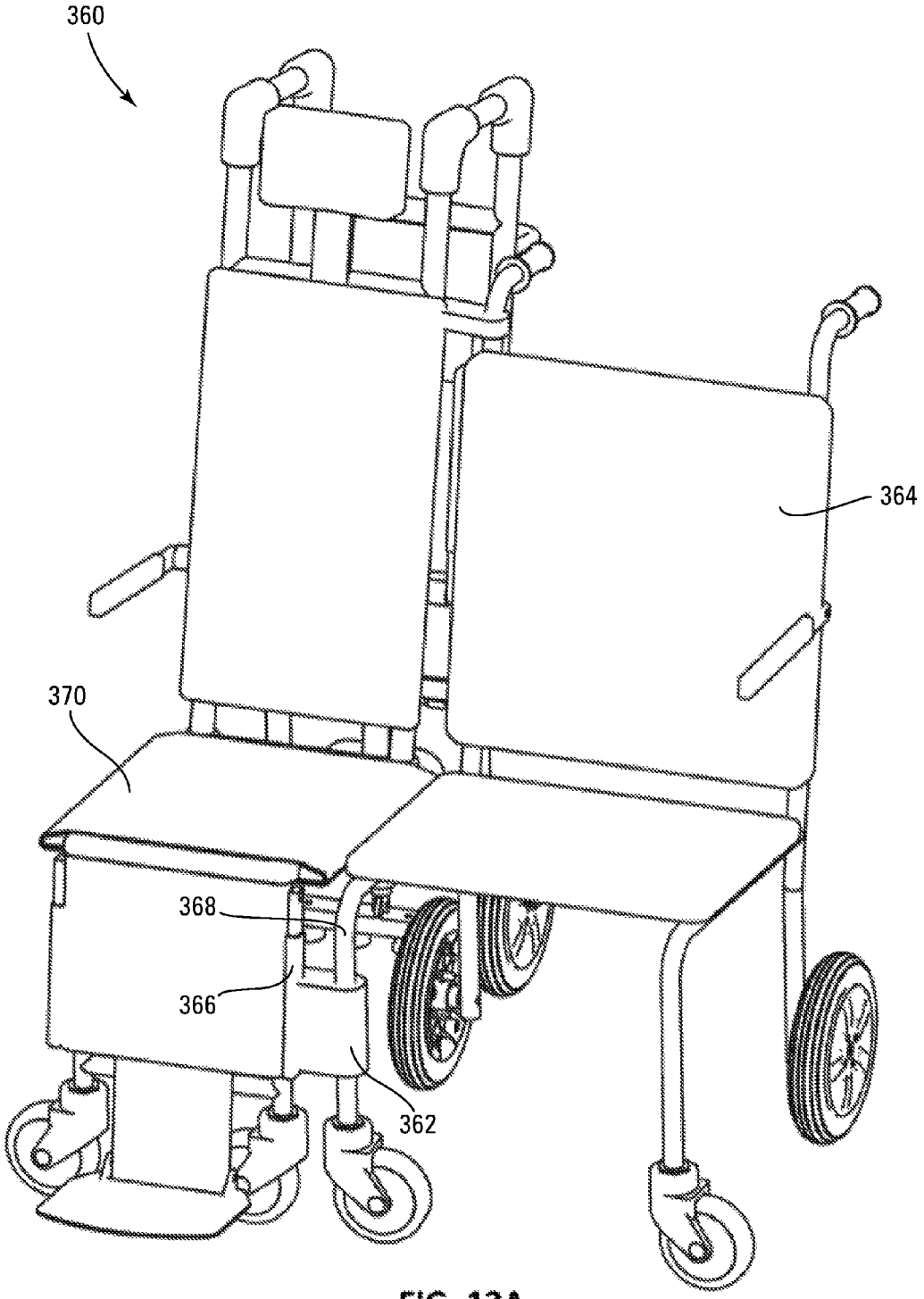
FIG. 13A is a perspective view of a wheelchair system having a transfer belt system that is coupleable to a transport chair, according to one embodiment.
Figure 13B:
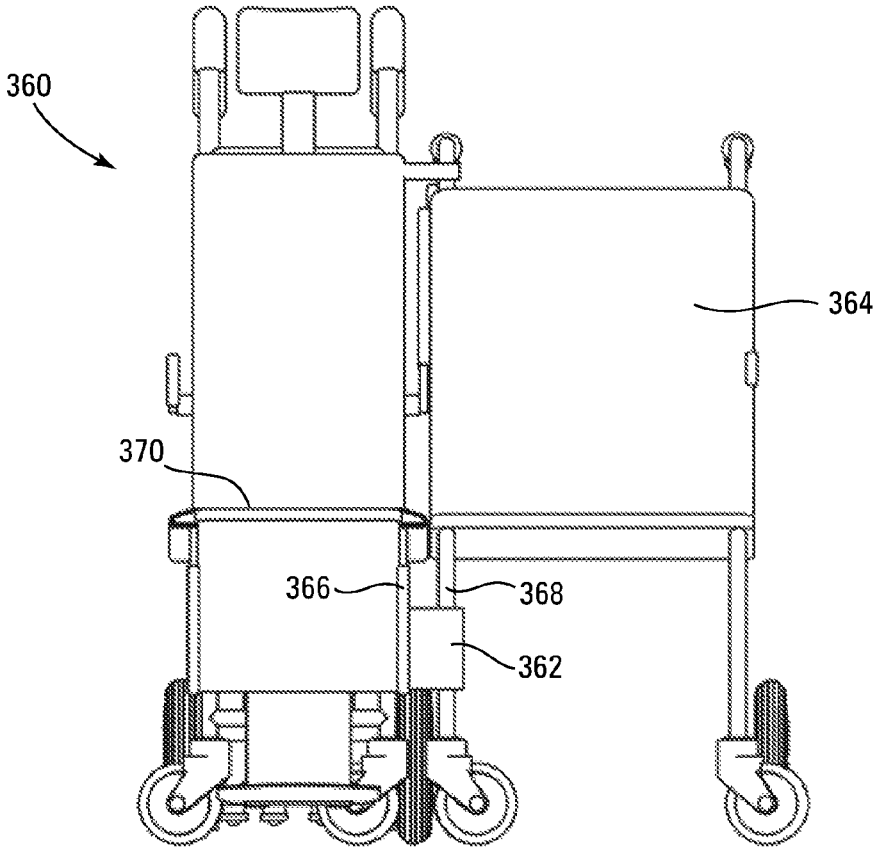
FIG. 13B is a front view of the wheelchair system of FIG. 13A, according to one embodiment.

FIGS. 13A and 13B depict a motorized wheelchair system chair 360 (similar to the system 260 described above) that is configured to be coupleable with another chair (which, in this example, is as an airport transport wheelchair such as those described above) 364. In this embodiment, the chair 360 has a coupling mechanism or system 362 that can be used to couple the chair 360 to the transport wheelchair 364. In this implementation, the coupling system 362 is positioned on the side of the chair leg 366 such that it can be used to couple the chair leg 366 (and thus the chair 360) to another chair leg such as the leg 368 of the chair 364 in the figure. Alternatively, the coupling system (not shown) can be positioned on the side of chair 360 and below the seat 370 such that it can be used to couple the chair 360 to another chair such as the chair 364 in the figure. In a further alternative, the coupling system can be coupled to a back leg of the chair 360 or elsewhere such that it can be used to couple to another chair such as the chair 364.

In use, when a user is going to be transferred from one chair to another, the chair 360 is positioned next to the other chair 364 and the coupling system 362 is coupled to the other chair 364. In this way, the two chairs 360, 364 are coupled to each other to provide stability such that the user can be transferred from one to the other without fear that the two chairs 360, 364 might move in relation to each other and cause the user to fall to the floor or ground. In one embodiment, depending in the direction of the transfer, the chair 360 could be raised or lowered as described above to facilitate the transfer. According to one embodiment, the coupling system 362 is configured to allow for 4-6 inches or more of movement of the chair 360 in relation to the other chair 364, thereby allowing for raising or lowering the chair 360.

Figure 14:
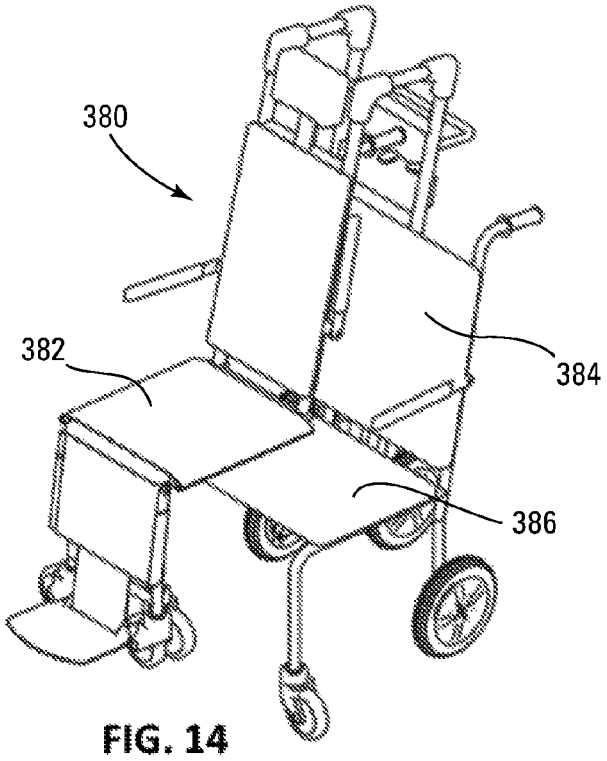
FIG. 14 is a perspective view of a wheelchair system having a transfer belt system that can be used in conjunction with a transport chair, according to another embodiment.

FIG. 14 depicts another motorized wheelchair system chair 380 (similar to the system chairs described above) that can be coupleable with or used in conjunction with another chair (which, in this example, is as an airport transport wheelchair such as those described above) 384. In this embodiment, instead of coupling the two chairs together with a coupling mechanism, the chair 380 is positioned next to the chair 384 and is raised or lowered until the transport system 382 on the chair 380 is slightly higher than the seat 386 of the chair 384. The chair 380 is further positioned so that a small portion of the transport system 382 is positioned on top of (or "overlapping with") the seat 386 of the chair 384. In one embodiment, the transport system 382 is either very close to or even in contact with the seat 386. Once the chairs 380, 384 are positioned in this fashion, the wheels on both chairs 380, 384 are locked such that the chairs are substantially fixed in that position. In use, when a user is going to be transferred from one chair to another, the chair 380 is positioned next to the other chair 384 as described above. The transport system 382 can then be used to transfer the passenger from one chair to the other.

Figure 15A:
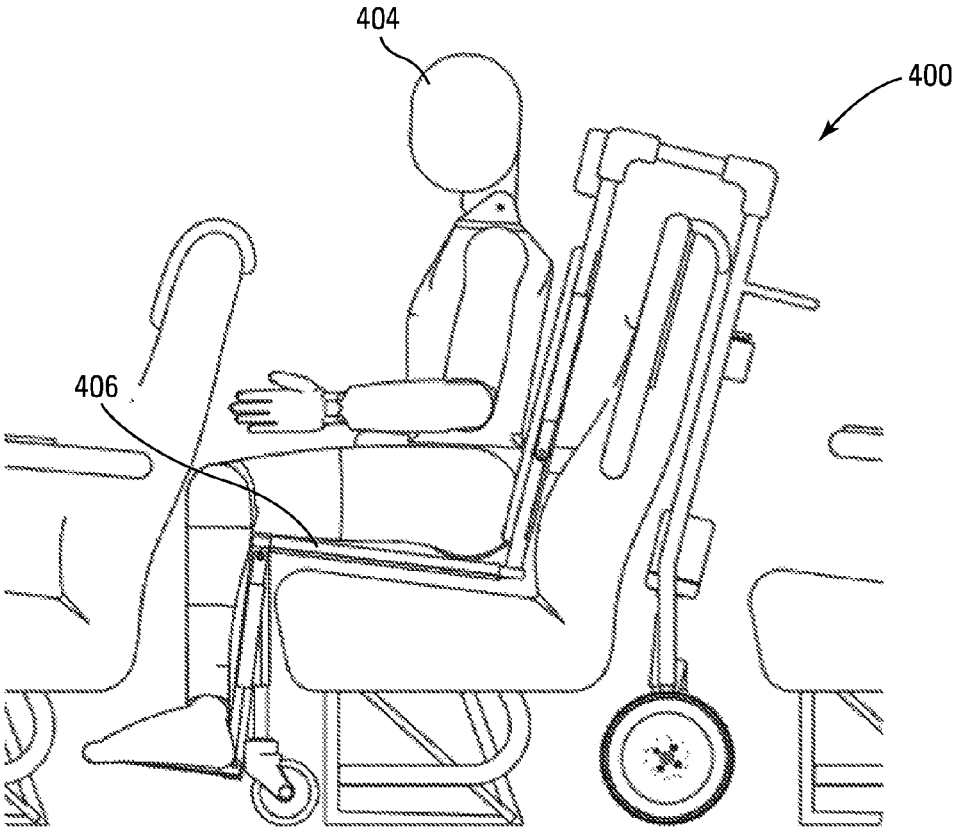
FIG. 15A is a side view of a wheelchair system having a transfer belt system being positioned next to an aircraft seat, according to one embodiment.
Figure 15B:
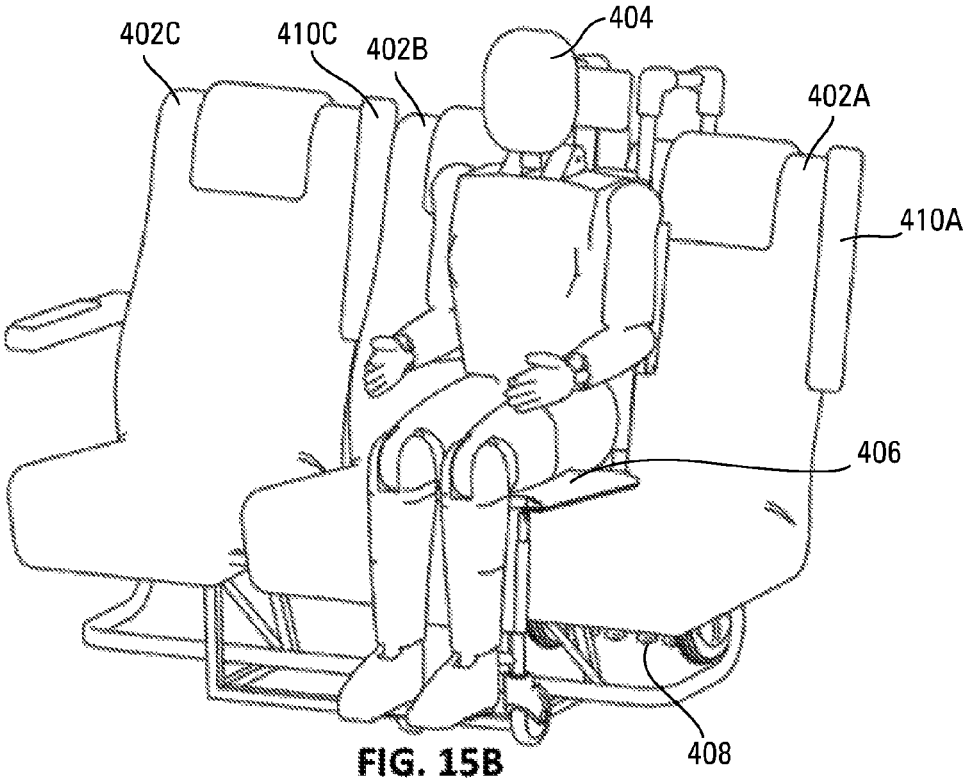
FIG. 15B is a perspective view of the wheelchair system of FIG. 15A being used to transfer a user from the wheelchair system to an aircraft seat, according to one embodiment.
Figure 15C:
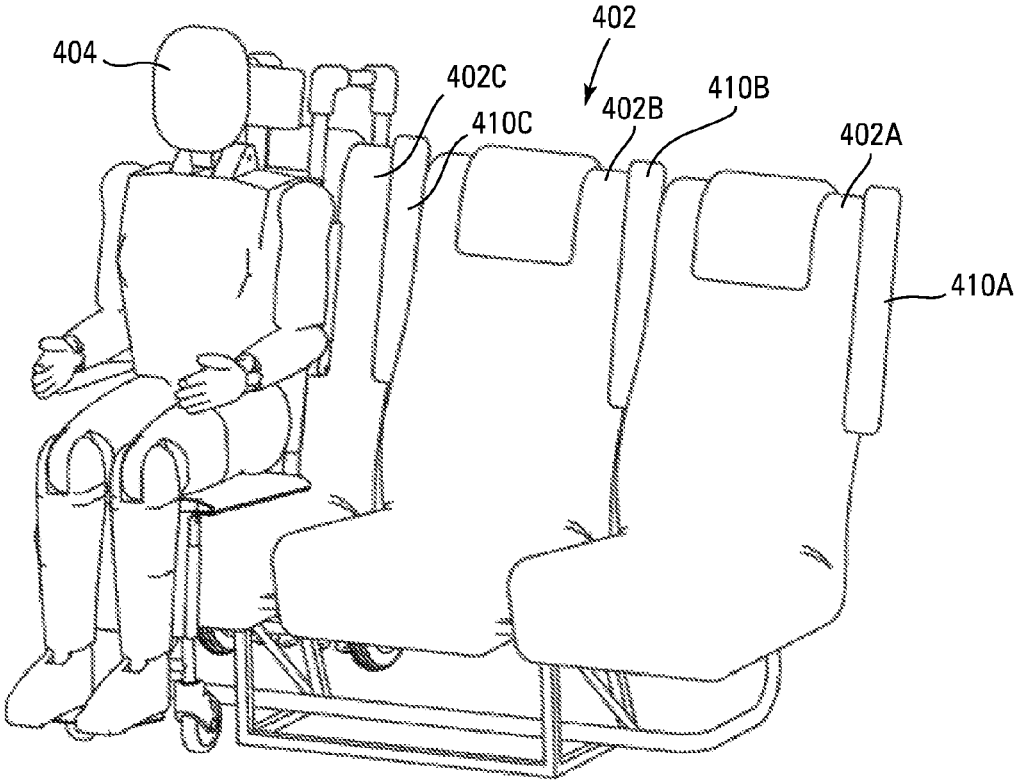
FIG. 15C is a perspective view of the wheelchair system of FIG. 15A being used to transfer a user from the wheelchair system to an aircraft seat, according to one embodiment.
Figure 15D:
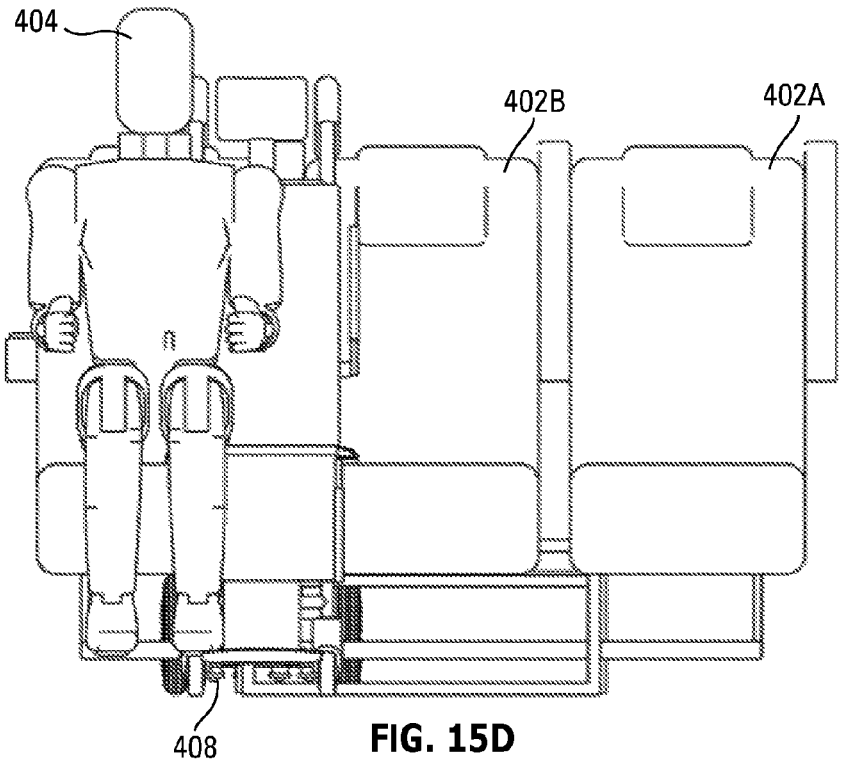
FIG. 15D is a perspective view of the wheelchair system of FIG. 15A being used to transfer a user from the wheelchair system to an aircraft seat, according to one embodiment.

In use, as best shown in FIGS. 15A-15D, a wheelchair system chair 400 with a lateral transport system 406 (similar to the chair embodiments 262, 360, 380 described above) can be used to transfer a user 404 between the chair 400 and another seat, such as an aircraft seat 402C as shown in FIGS. 15B and 15C. The example of a transfer from the wheelchair system 400 to an aircraft seat 402C will be described herein, but it is understood that the transfer from the seat 402C to the chair 400 works in a similar fashion, but with the steps reversed. First, the system 400 is positioned appropriately in the aircraft aisle next to the aisle seat 402A of the desired row 402 in the aircraft. Then the height of the chair 400 is adjusted to better fit over the seats 402A, 402B, 402C of the row 402, as best shown in FIG. 15A. At this point, as best shown in FIG. 15B, the deployable secondary wheel system 408 (similar to the secondary wheel system described above) is deployed, the armrests 410A, 410B, 410C (as best shown in FIG. 15C) of the aircraft seats 402A, 402B, 402C are raised, and the chair 400 is then urged over the seats 402A, 402B, 402C. When the chair 400 is positioned next to or over seat 402C as shown in FIG. 15C, the chair 400 is then lowered until the chair 400 is almost or actually is in contact with the seat 402C. At this point, as best shown in FIG. 15D, the lateral transport system 406 is actuated to urge the user 404 laterally onto the seat 402C. According to one implementation, depending on the positioning of the chair 400, the chair 400 can also be urged in the opposite direction (toward the aircraft aisle) at the same time. Once the user is seated appropriately on the seat 402C, the chair 400 is urged back into the aisle and removed from the aircraft.

Figure 16A:
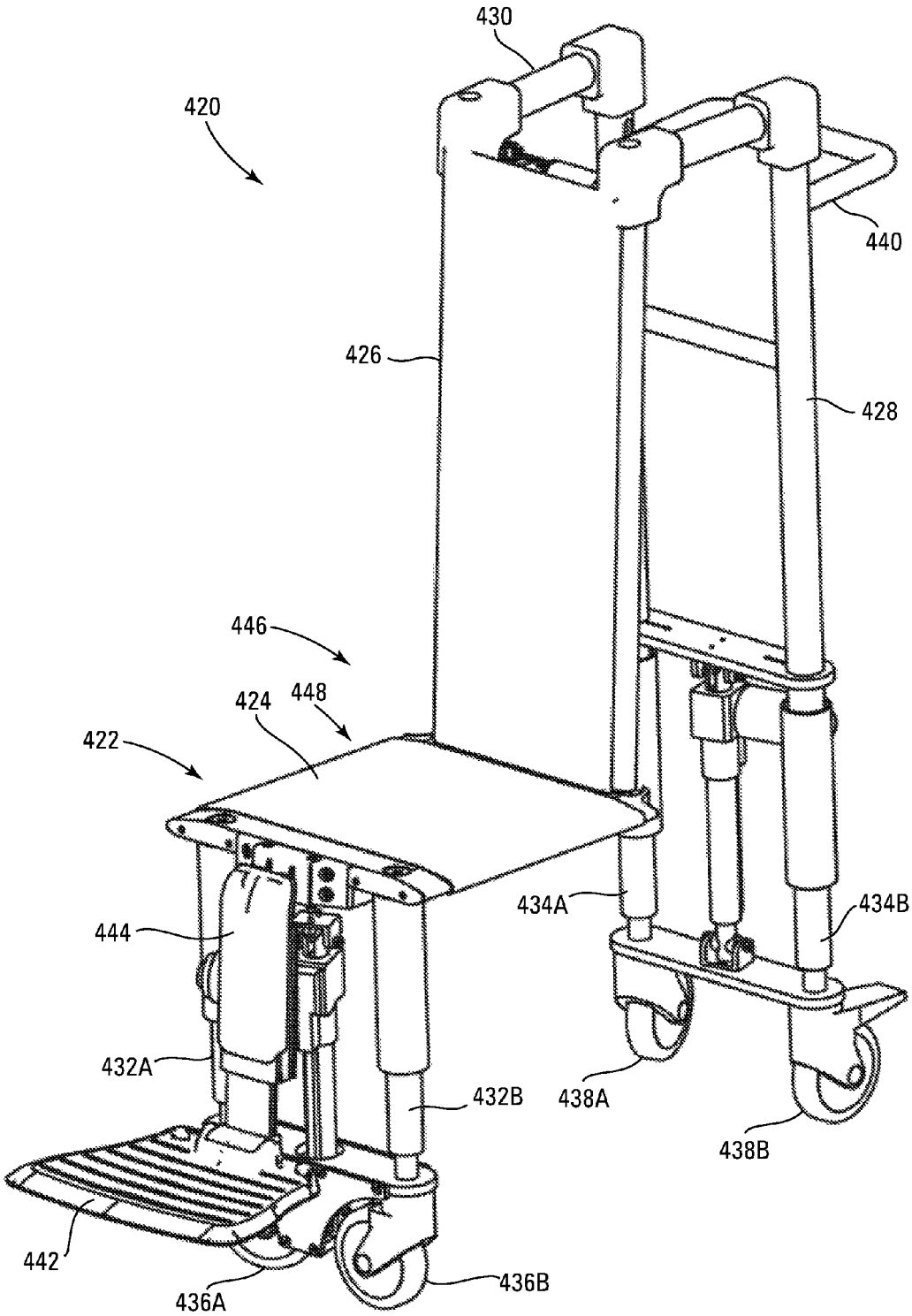
FIG. 16A is a perspective view of a wheelchair system having a transfer belt system, according to another embodiment.
Figure 16B:
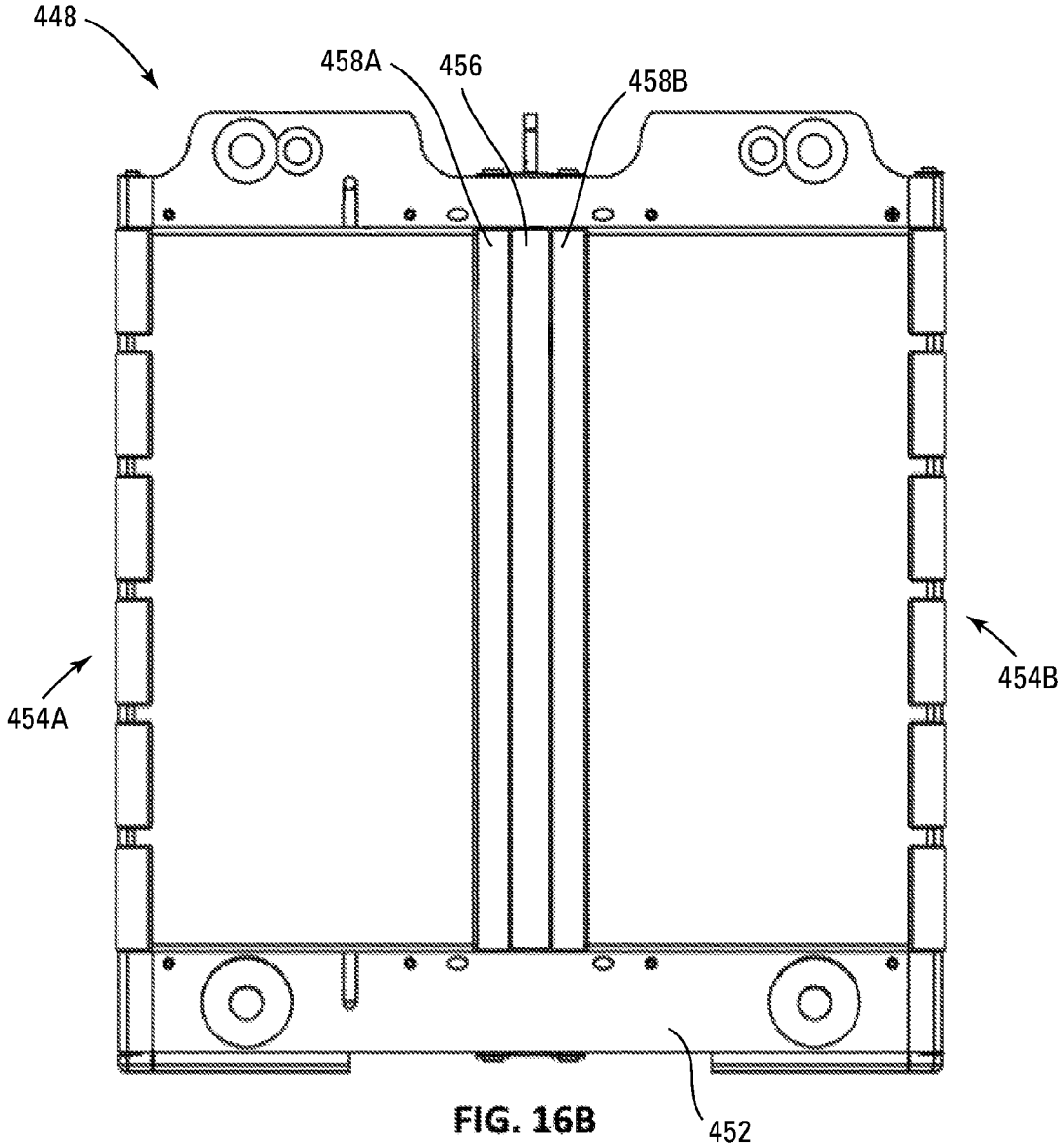
FIG. 16B is a top view of a portion of the transfer belt system of the wheelchair system of FIG. 16A, according to one embodiment.
Figure 16C:
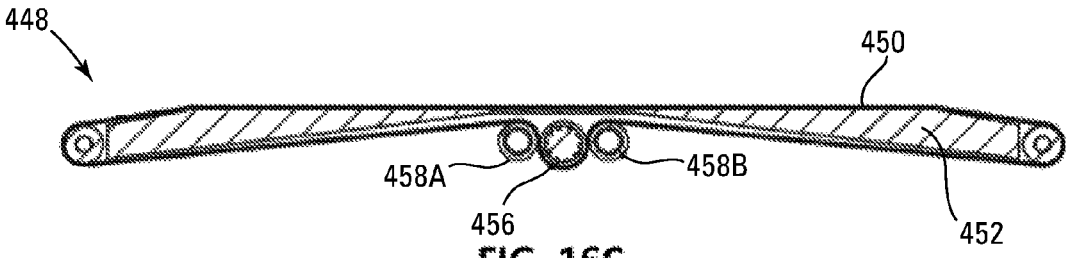
FIG. 16C is a front cross-sectional view of the transfer belt system of the wheelchair system of FIG. 16A, according to one embodiment.

Another motorized wheelchair system 420 embodiment is depicted in FIGS. 16A-16C. This system implementation 420 is a chair frame 422 with a seat 424, a seat back 426, a rear frame support 428, and a connector 430 connecting the seat back 426 and rear frame support 428. In addition, the chair frame 422 has two front legs 432A, 432B coupled to the seat 424, and two back legs 434A, 434B coupled to the rear frame support 428. In addition, the chair frame 422 has two front wheels 436A, 436B coupled to the two front legs 432A, 432B and two back wheels 438A, 438B coupled to the two back legs 434A, 434B. According to one embodiment, the wheels 436A, 436B 438A, 438B are lockable wheels that can be locked in position.

One embodiment of the system 420 also has a handle 440 coupled to the rear frame support 428. Further, the chair frame 422 also has a foot rest 442 (or, alternatively, two separate foot rests, each sized to receive one of the user's two feet) coupled to the chair frame 422 with a foot rest connector 444.

Similar to system 260, the system 420 in this implementation is sized and configured to be positionable over and around a standard airplane seat such that the seat back 426 is positioned in front of the airplane seat, the rear frame support 428 is positioned behind the airplane seat, and the connector 430 is positioned above the airplane seat. According to one embodiment, the connector 430 is adjustable such that the depth of chair frame 422 (the distance or space defined between the seat back 426 and the rear frame support 428) can be adjusted to make it possible to position the system 420 over airplane seats of various sizes and depths.

In certain embodiments, the system 420 can also be configured such that the height of the chair frame 262 can be adjusted. It is understood that this height adjustment can be accomplished in any known fashion, including configurations provided in other embodiments disclosed herein. It is further understood that the chair frame 422 can also have at least one motor (not shown) coupled thereof.

The system 420, according to one implementation, has an integrated lateral transfer system 446 that is made up of at least a seat transfer belt system 448 positioned on the seat 424. In this particular embodiment, the system 446 includes only the seat transfer belt system 448. Alternative embodiments also include a seat back transfer belt system (not shown) positioned on the seat back 266, as described with respect to system 260.

FIGS. 16B and 16C depict the seat transfer belt system 448 in detail, with FIG. 16B showing a top view of the system 448 with the belt removed and FIG. 16C showing a cutaway front cross-sectional view of the system 448. The transfer belt system 448 has a belt 450 positioned on and around a belt system frame (also referred to as a "base") 452. The frame 452 has two sets of external support rollers (also referred to as "external rollers," "support rollers," or "edge rollers") 454A, 454B—one set 454A on one end of the frame 452 and another set 454B on the opposite end. The two sets of external rollers 454A, 454B are positioned on the ends of the frame 452 to receive the belt 450 and facilitate movement of the belt 450 around the frame 452.

As best shown in FIGS. 16B and 16C the system 448 has a drive roller 456 positioned beneath the frame 452 between two compression support rollers (also referred to as "compression rollers" or "support rollers") 458A, 458B. The drive rollers 456 is configured to provide motive force to drive the belt 450. In this implementation, the drive roller 456 is positioned between the two compression rollers 458A, 458B such that the belt 450 is configured to be positioned over the two compression rollers 458A, 458B and under the drive roller 456. In this configuration, the rollers 456, 458A, 458B create sufficient friction on the belt 450 as it threads between the drive roller 456 and the two compression rollers 458A, 458B such that rotation of the drive roller 456 causes the belt 450 to move around the frame 452. It is understood that the drive roller 456 can be actuated in any known fashion using a motor or other source of motive force.

In use, the system 420 and seat transfer belt system 448 can be used in a fashion substantially similar to similar systems disclosed herein, such as system 260.

Although the present invention has been described with reference to preferred embodiments, persons skilled in the art will recognize that changes may be made in form and detail without departing from the spirit and scope of the invention.

What is claimed is:

1. A wheelchair transfer system, comprising:

(a) a wheelchair seat, the wheelchair seat comprising a transfer belt system;

(b) first and second front legs operably coupled to the wheelchair seat;

(c) first and second front wheels operably coupled to the first and second front legs;

(d) a seat back operably coupled to the wheelchair seat;

(e) a rear frame support operably coupled to the seat back via a connector, wherein a space is defined between the seat back and rear frame, wherein the space is sufficiently large to allow an aircraft seatback to be positioned between the seat back and rear frame;

(f) first and second rear legs operably coupled to the seat back; and (g) first and second rear wheels operably coupled to the first and second rear legs.

2. The wheelchair transfer system of claim 1, wherein the first and second front wheels and the first and second rear wheels are swivel wheels.

3. The wheelchair transfer system of claim 1, wherein the first and second front wheels are swivel wheels and the first and second rear wheels are fixed wheels.

4. The wheelchair transfer system of claim 3, further comprising a secondary wheel system comprising at least two secondary wheels positioned between the first and second rear wheels, wherein the secondary wheel system is configured to move between an undeployed configuration and a deployed configuration in which the two secondary wheels are in contact with a floor whereby the transfer system can be moved sideways via the two secondary wheels.

5. The wheelchair transfer system of claim 1, wherein the transfer belt system comprises:

(a) a support frame;

(b) a transfer belt positioned around the support frame;

(c) at least one drive roller operably coupled to the support frame, wherein the at least one drive roller is operably coupled to the support frame whereby rotation of the at least one drive roller causes the transfer belt to move around the support frame; and (d) at least one support roller operably coupled to the support frame, wherein the at least one support roller is configured to provide support to the transfer belt.

6. The wheelchair transfer system of claim 5, wherein the at least one drive roller comprises first and second drive rollers and the at least one support roller comprises a plurality of support rollers, wherein the plurality of support rollers are disposed between the first and second drive rollers.

7. The wheelchair transfer system of claim 5, wherein the at least one support roller comprises first and second compression support rollers, wherein the at least one driver roller is disposed between the first and second compression support rollers.

8. A wheelchair transfer system, comprising:

(a) a wheelchair seat;

(b) a transfer belt system associated with the wheelchair seat, the transfer belt system comprising:

(i) a support frame;

(ii) a transfer belt positioned around the support frame;

(iii) at least one drive roller operably coupled to the support frame, wherein rotation of the at least one drive roller causes the transfer belt to move around the support frame; and (iv) at least one support roller operably coupled to the support frame, wherein the at least one support roller is configured to provide support to the transfer belt;

(c) first and second front legs operably coupled to the wheelchair seat, the first and second front legs comprising first and second front wheels, respectively;

(d) a seat back operably coupled to the wheelchair seat;

(e) a rear frame support operably coupled to the seat back via a connector, wherein a space is defined between the seat back and rear frame, wherein the space is sufficiently large to allow an aircraft seatback to be positioned between the seat back and rear frame support; and (f) first and second rear legs operably coupled to the seat back, the first and second rear legs comprising first and second rear wheels, respectively.

9. The wheelchair transfer system of claim 8, wherein the at least one drive roller comprises first and second drive rollers and the at least one support roller comprises a plurality of support rollers, wherein the plurality of support rollers are disposed between the first and second drive rollers, wherein the first and second drive rollers and the plurality of support rollers are disposed substantially within the support frame, wherein the transfer belt is disposed around the first and second drive rollers and the plurality of support rollers.

10. The wheelchair transfer system of claim 9, wherein each of the first and second drive rollers comprises at least one coupling section comprising coupleable threads, wherein the at least one coupling section is configured to be coupleable with the transfer belt, wherein the transfer belt is configured to be coupleable with the at least one coupling section.

11. The wheelchair transfer system of claim 8, further comprising first and second sets of external rollers operably coupled to the support frame, wherein the first set of external rollers is disposed along a first external edge of the support frame and the second set of external rollers is disposed along a second external edge of the support frame, wherein the transfer belt is disposed around the first and second sets of external rollers, wherein the at least one support roller comprises first and second compression support rollers, wherein the at least one driver roller is disposed between the first and second compression support rollers, wherein the transfer belt is threaded through the at least one driver roller and the first and second compression support rollers.

12. A wheelchair transfer system, comprising:

(a) a frame comprising:

(i) a seat;

(ii) a seat back operably coupled to the seat;

(iii) a rear frame support operably coupled to the seat back; and (iv) first and second front legs and first and second rear legs operably coupled to the frame;

(b) a transfer belt system associated with the seat; and (c) an aircraft seatback space defined by the seat back and the rear frame.

13. The wheelchair transfer system of claim 12, further comprising first and second front wheels operably coupled to the first and second front legs and first and second rear wheels operably coupled to the first and second rear legs.

14. The wheelchair transfer system of claim 13, wherein at least the first and second front wheels are swivel wheels.

15. The wheelchair transfer system of claim 13, wherein the first and second rear wheels are fixed wheels.

16. The wheelchair transfer system of claim 13, further comprising a secondary wheel system comprising at least two secondary wheels positioned between the first and second rear wheels, wherein the secondary wheel system is configured to move between an undeployed configuration and a deployed configuration in which the two secondary wheels are in contact with a floor whereby the transfer system can be moved sideways via the two secondary wheels.

17. The wheelchair transfer system of claim 12, wherein the transfer belt system comprises a support frame and a transfer belt positioned around the support frame.

18. The wheelchair transfer system of claim 17, further comprising at least one drive roller operably coupled to the support frame, wherein rotation of the at least one drive roller causes the transfer belt to move around the support frame.

19. The wheelchair transfer system of claim 17, further comprising at least one support roller operably coupled to the support frame, wherein the at least one support roller is configured to provide support to the transfer belt.

20. The wheelchair transfer system of claim 12, wherein the transfer belt system comprises:

(a) a support frame;

(b) a transfer belt positioned around the support frame;

(c) at least one drive roller operably coupled to the support frame, wherein the at least one drive roller is operably coupled to the support frame whereby rotation of the at least one drive roller causes the transfer belt to move around the support frame; and (d) at least one support roller operably coupled to the support frame, wherein the at least one support roller is configured to provide support to the transfer belt.

* * * * *